US010624806B2

(12) United States Patent
Emerson et al.

(10) Patent No.: US 10,624,806 B2
(45) Date of Patent: Apr. 21, 2020

(54) AIR-BEARING PATIENT TRANSFER SYSTEM

(71) Applicant: CEGA Innovations, Inc., Sioux Falls, SD (US)

(72) Inventors: Aaron J. Emerson, Sioux Falls, SD (US); Matthew Rust, Hudson, WI (US)

(73) Assignee: CEGA Innovations, Inc., Sioux Falls, SD (US)

( * ) Notice: Subject to any disclaimer, the term of this patent is extended or adjusted under 35 U.S.C. 154(b) by 107 days.

(21) Appl. No.: 15/991,597

(22) Filed: May 29, 2018

(65) Prior Publication Data

US 2019/0091085 A1 Mar. 28, 2019

Related U.S. Application Data

(60) Provisional application No. 62/563,906, filed on Sep. 27, 2017.

(51) Int. Cl.

| | |
|---|---|
| ***A61G 7/10*** | (2006.01) |
| ***A61G 7/05*** | (2006.01) |
| ***A61G 1/003*** | (2006.01) |
| ***A61G 1/044*** | (2006.01) |
| ***A61G 13/12*** | (2006.01) |

(52) U.S. Cl.

CPC ..... *A61G 7/1028* (2013.01); *A61G 1/003* (2013.01); *A61G 1/044* (2013.01); *A61G 7/0504* (2013.01); *A61G 7/1021* (2013.01); *A61G 7/1026* (2013.01); *A61G 7/1036* (2013.01); *A61G 13/1265* (2013.01)

(58) Field of Classification Search

CPC ..... A61G 7/1028; A61G 1/003; A61G 1/044; A61G 7/05

See application file for complete search history.

(56) References Cited

U.S. PATENT DOCUMENTS

| | | | |
|---|---|---|---|
| 1,981,666 | A | 11/1934 | Ridley |
| 3,014,224 | A | 12/1961 | Hall |
| 3,129,438 | A | 4/1964 | Hall |
| 4,054,960 | A | 10/1977 | Pettit et al. |

(Continued)

FOREIGN PATENT DOCUMENTS

| | | | |
|---|---|---|---|
| EP | 0439808 | A1 | 8/1991 |

OTHER PUBLICATIONS

"Defining Adult Overweight and Obesity", Center for Disease and Prevention, www.cdc.gov/obesity/adult/defining.html [online], [Accessed Dec. 17, 2018], Jun. 16, 2016, pp. 1-4.

(Continued)

*Primary Examiner* — Eric J Kurilla

(74) *Attorney, Agent, or Firm* — Dorsey & Whitney LLP

(57) ABSTRACT

A transfer system includes an air-bearing support with first and second longitudinal sections. A port is provided in flow communication with the first and second longitudinal sections, and configured for inflation of the air-bearing support for transfer of a patient or other body. A selective coupling extends between the first and second longitudinal sections, adapted to attach the first and second sections together for transfer of the body on the air-bearing support, and to at least partially detach the first and second longitudinal sections for separation and removal, e.g., upon deflation of the patient support, after the transfer is accomplished.

20 Claims, 13 Drawing Sheets

(56) References Cited

U.S. PATENT DOCUMENTS

| | | | | |
|---|---|---|---|---|
| 4,207,633 | A | 6/1980 | Imel et al. | |
| 4,528,704 | A | 7/1985 | Wegener et al. | |
| 4,627,426 | A | 12/1986 | Wegener et al. | |
| 5,483,709 | A | 1/1996 | Foster et al. | |
| 6,073,291 | A | 6/2000 | Davis | |
| 6,820,938 | B2 | 11/2004 | Barrett | |
| 7,007,330 | B2 | 3/2006 | Kuiper et al. | |
| 7,266,852 | B2 | 9/2007 | Davis | |
| 7,406,723 | B2 | 8/2008 | Davis | |
| 7,415,738 | B2 | 8/2008 | Weedling et al. | |
| 7,574,761 | B2 | 8/2009 | Davis | |
| 7,575,761 | B2 | 8/2009 | Bennett et al. | |
| 9,101,521 | B2 | 8/2015 | White et al. | |
| 9,314,388 | B2 | 4/2016 | Patrick | |
| 2003/0159212 | A1 | 8/2003 | Patrick et al. | |
| 2005/0076437 | A1 | 4/2005 | Johnson | |
| 2007/0094805 | A1 | 5/2007 | Davis | |
| 2013/0042414 | A1 | 2/2013 | Schreiber et al. | |
| 2016/0367422 | A1 | 12/2016 | Weedling | |
| 2019/0091086 | A1* | 3/2019 | Emerson | A61G 7/1028 |

OTHER PUBLICATIONS

"International Search Report and the Written Opinion of the International Searching Authority", PCT/US2018/034904, dated Sep. 17, 2018, 10 pages.

* cited by examiner

AIR-BEARING PATIENT TRANSFER SYSTEM

CROSS REFERENCE TO RELATED APPLICATION

This application claims the benefit under 35 U.S.C. § 119(e) of U.S. Provisional Application No. 62/563,906, filed Sep. 27, 2017, and entitled AIR-BEARING PATIENT TRANSFER SYSTEM, the entire disclosure of which is hereby incorporated by reference herein for all purposes.

TECHNICAL FIELD

This disclosure relates generally to patient transport in hospital and clinical environments, and other medical or patient care settings. In particular, the disclosure relates to a patient transfer system for transferring a patient from one surface to another, for example between beds or gurneys in an operating room, or in an examination, laboratory, treatment, or recovery location.

BACKGROUND

In the day to day operations of a hospital, patients frequently are moved from one surface to another surface. In many instances, patients are not ambulatory and are moved via a gurney with the assistance of nursing and/or medical staff. For example, when a patient undergoes surgery, even an ambulatory patient may be rendered non-ambulatory by virtue of the operation and/or due to the effects of anesthesia.

Non-ambulatory patients typically are moved via a gurney whenever there is a need to move a patient to a new area. For example, after surgery, the nursing and/or medical staff typically transfer the patient to a gurney for transport from the surgery room to the recovery room. Generally, the patient stays on the gurney while in the recovery room. Upon recovery, the patient is moved on the gurney to the hospital room. Once at the hospital room, the patient is moved from the gurney to the hospital bed by nursing and/or medical staff.

Some prior art devices used to move a patient are disclosed in U.S. Pat. Nos. 4,528,704; 5,483,709; 6,073,291; 7,007,330; 7,415,738; 7,574,761; and 9,314,388; and in U.S. Patent Publication Numbers 2003/0159212, 2005/0076437, 2013/0042414, and 2016/0367422, each of which is incorporated by reference herein. The present disclosure discloses a device that provides improvements and/or alternatives to these prior art devices.

SUMMARY

Various examples and embodiments described herein relate to an inflatable patient transfer system for transferring a patient or other body between surfaces, for example between beds, gurneys, or other locations in a hospital operating room, and in other clinical, laboratory, examination, treatment, transportation and recovery environments.

DETAILED DESCRIPTION

Figure 1A:
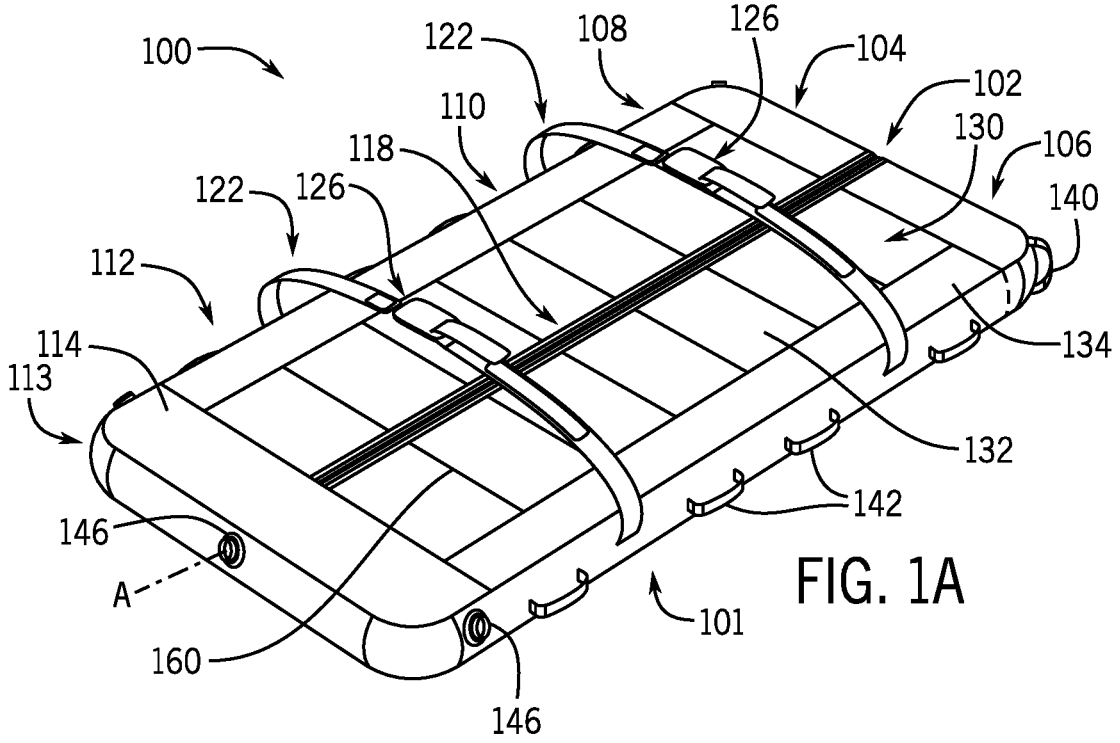
FIG. 1A is a perspective view of an air-bearing patient transfer system, according to various embodiments of the present disclosure.

FIG. 1A is a perspective view of an air-bearing, inflatable patient transport system 100. As shown in FIG. 1A, patient transfer system 100 includes an inflatable, air-bearing support apparatus or device 101 with an axial division or slit 102 defining two detachable longitudinal sections 104 and 106 coupled together along a releasable seam 118 extending from a proximal or head region 108 of the device 101 through a middle torso region 110 and lower limb or leg region 112 toward a foot region 113.

Patient transfer system 100 is designed to move a patient from one lateral surface to another, and to be easily removable from beneath the patient after the transfer, without the need for additional rolling manipulations or other disturbances to the patient's body. For example, the inflatable device 101 can be placed beneath a patient in a deflated state, before starting a medical procedure, so that after the procedure is completed the device 101 can be inflated with the patient disposed on the top surface 130 (e.g., in the central portion 132 within border 134), without rolling patient's torso or other substantial physical manipulation by the caregivers. Using an air blower (such as a high volume air blower), the system 100 can also be provided with sufficient airflow via one or more ports or inlets 146 so the air-bearing patient support 101 hovers at least partially supported on a bed of pressurized air escaping through small holes on the bottom side, reducing friction and allowing for reduced or minimal force required to move the patient.

The patient can be strapped to the patient support 101 using one or more straps 122 with adjustable couplings 126, and transferred by sliding the patient support 101 along a transfer surface (or from one surface onto another), e.g., using one or more handles 140, 142. After the patient transfer is complete, the system 100 is deflated and the patient support 101 is removed from beneath the patient by pulling the device 101 apart in opposite directions, e.g., using the removal tabs or handles 140, splitting the main body portion of the support 101 down the center or midline axis A into two separate longitudinal sections 104 and 106.

Starting at the patient's head region 108 and moving from the torso region 110 toward the lower leg region 112, the longitudinal sections 104, 106 of the patient support 101 easily peel out from beneath each side of the patient's torso region 110, the area of greatest weight and mass. In some embodiments, the longitudinal sections 104, 106 remain connected by a lateral section 114, e.g. in the foot region 113. After use, system 100 may be disposed of pursuant to local regulations and hospital protocols for safe, sanitary surgical disposal.

Conventional inflatable "hovering" transfer devices generally require patient manipulation to remove the device from beneath the patient. In contrast, the patient transfer system 100 does not require additional patient manipulation for removal, due to the design and construction of the patient support 101, allowing the system 100 to be removed by separating the air-bearing patient support 101 down its center or axis A.

Figure 1B:
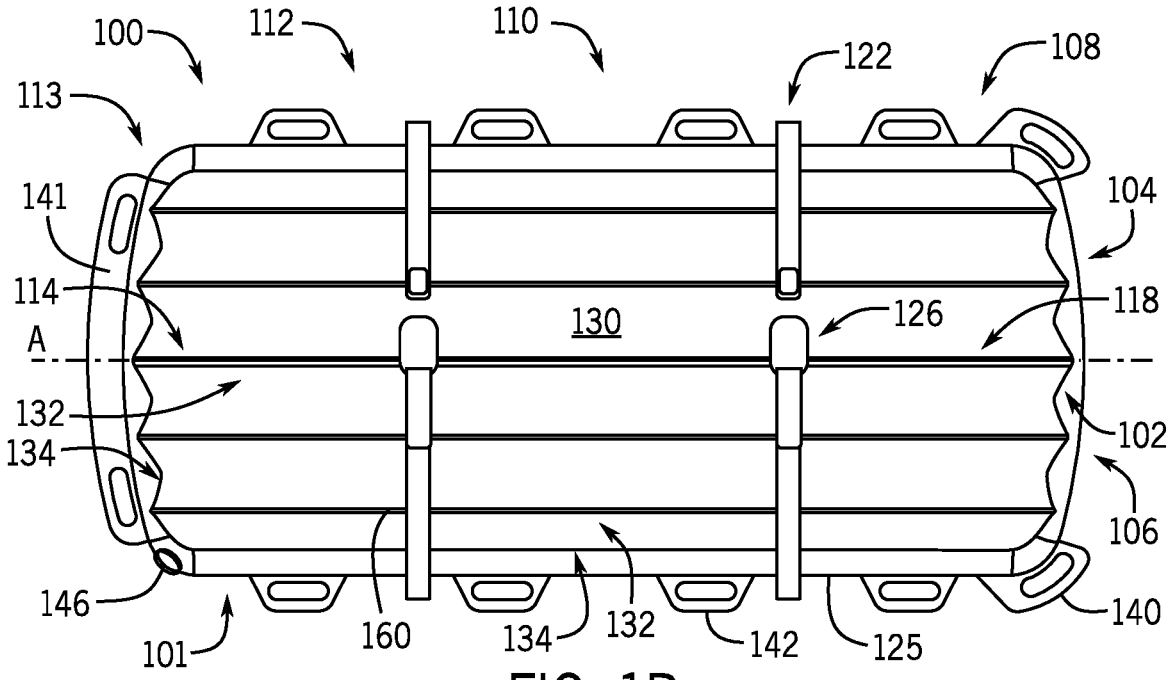
FIG. 1B is a plan view of the patient transfer system, in an alternate embodiment.

FIG. 1B is a plan view of an alternate patient transfer system 100. In contrast to the embodiment of FIG. 1A, which can be manufactured of textile materials using a machine sewing construction process, the patient transfer system 100 of FIG. 1B can be formed of a welded polymer sheet design. In this process, the top and bottom layers of the patient support 101 are "stamped" together or disposed one on top of the other, and welded together at the perimeter 125 to define is the inflatable air-bearing patient support 101. Suitable welding processes include, but are not limited to, heat welds, chemical welding, and radio frequency (RF) welding methods. Additional welds can be used to define or attach other features such as handles 140 and tabs 142, along with additional features such as internal baffles and extended handle structures 141 on one or both ends of the patient support 141.

Depending on application, a perforated longitudinal seam 118 can be used to secure the longitudinal sections 104, 106 together across the axial separation 102 during the transfer process, and to function as a release point or release mechanism for separating the sections 104, 106 after the transfer. This configuration presents the "air mattress" assembly or patient support device 101 as a substantially single unit, formed of a substantially continuous and unitary or homogeneous (uniform) material, as opposed to using a partitioned unit with two separate sections joined by an intermediary tear surface formed of a different material, e.g., a fabric web or textile material as contemplated in a sewn construction of the patient support 101.

The air holding and pressure seal features of system 100 that define the inflatable patient support 101 may include one or more internal baffles 160 extending longitudinally on either side 104, 106 of the perforated seam 118. While perforating the patient support 101 through the inflated area could cause air loss and premature separation, small air-bearing flow apertures can be formed on the bottom surface, as described above, and the perforated seam 118 can be defined with sufficient width to form a pressure seal about the perimeter of each perforation, in order to maintain internal pressure in the longitudinal sections 104, 106. The welded, substantially unitary manufacture of the air-bearing device 110 may also substantially reduce system weight and manufacturing costs, as compared to conventional devices.

Figure 2:
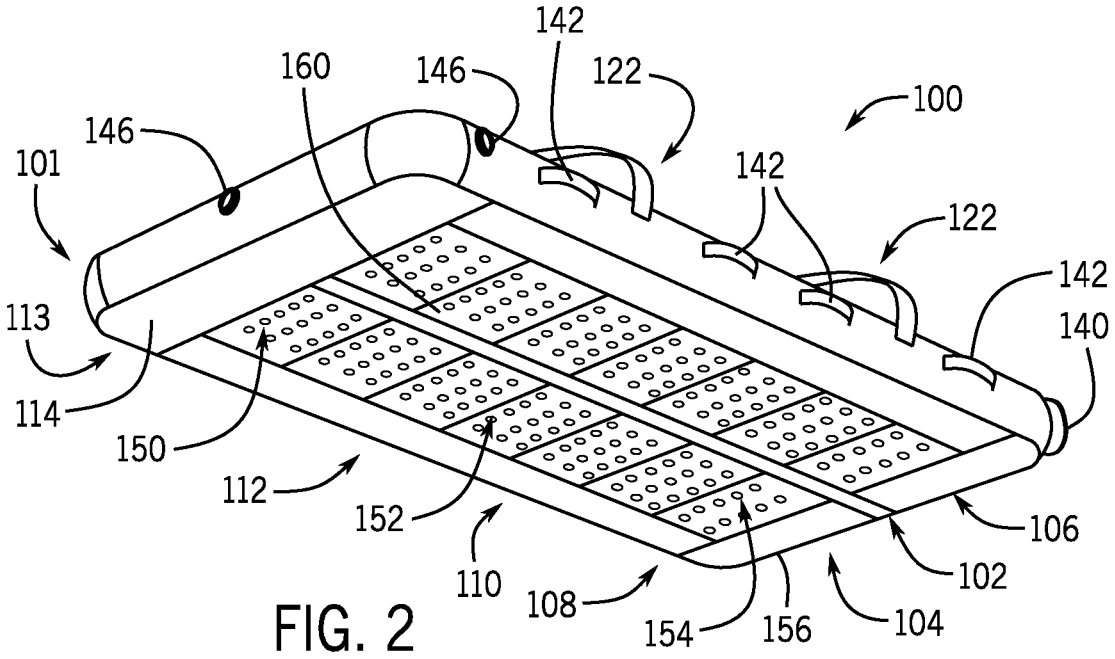
FIG. 2 is a bottom view of the patient transfer system.

FIG. 2 is a bottom perspective view of the patient transfer system 100, e.g., in a machine sewn construction as shown in FIG. 1A. The features shown in FIG. 2 are also equally suited to a welded polymer construction, e.g., as shown in FIG. 1B.

The inflatable patient transfer system 100 is configured to support a patient's body on the inflated patient support 101, distributing the patient's weight more evenly over the bottom surface 150 and reducing friction to facilitate the patient transfer. As shown in FIG. 2, the bottom surface 150 of the support 101 may also include a plurality of small apertures, perforations or holes 152, which are configured to allow air inside of the inflated bed or patient support 101 to escape in a controlled manner, so as to provide a cushion of air flowing beneath the bottom surface 150.

Depending on design, sufficient airflow can be generated through the holes or apertures 152 to at least partially support the bottom surface 150, reducing frictional contact with the transfer surfaces in order to move the system 100 while a patient is lying on the patient support 101. In particular applications, the airflow may be sufficient so that the patient support 101 hovers over the transfer surface, along part or substantially all of the bottom surface 150. More generally, the patient support 101 can be adapted to utilize a combination of weight redistribution, airflow, and reduced friction materials on bottom surface 150, in order to more easily and efficiently effect the patient transfer.

For example, a number of small apertures 152 may be formed in a core area 154 disposed in a middle part of the bottom surface 150, and the core area 154 may be recessed relative to a reduced friction border area 156 extending about the periphery of the device 101 in order to create a weight-bearing layer of air below the core area 154 to support the system 100 during the patient transfer. More generally, the airflow can be sufficient to at least partially support any or all of the bottom surface 150 of the device 101, and to facilitate sliding the system 100 along the transfer surface, or from one transfer surface to another (e.g., between an operating table, examination table, or other surface upon which a medical procedure is performed, and a bed or gurney for patient transport, or along or between any such surfaces).

Figure 3A:
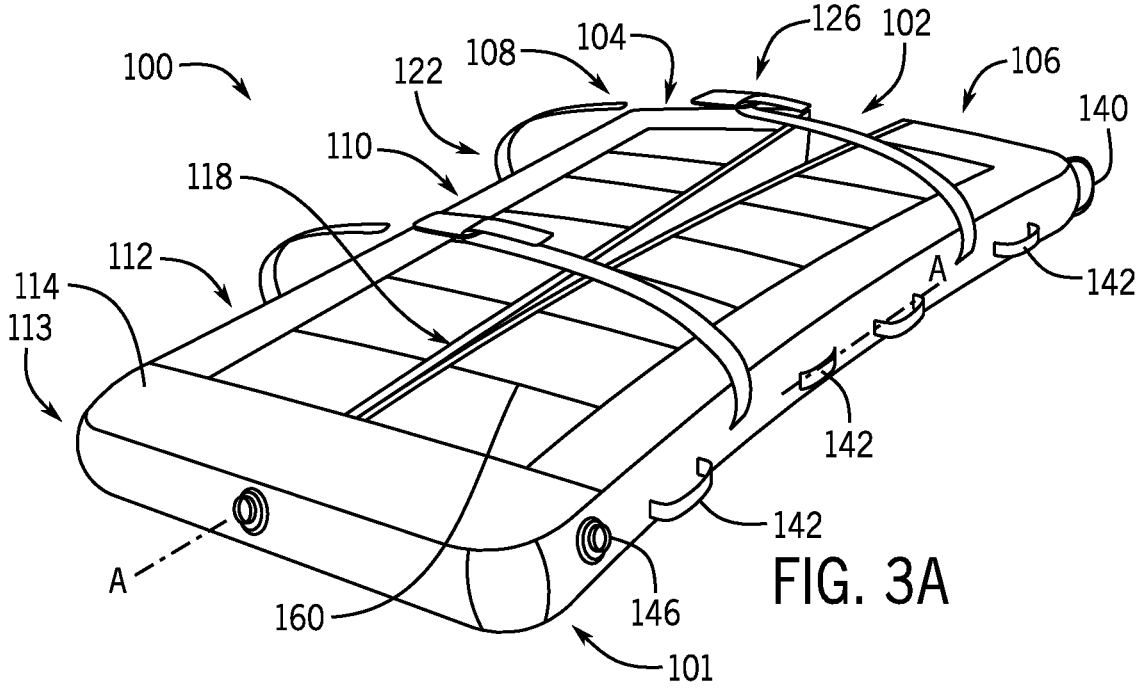
FIG. 3A is a perspective view of the patient transfer system, in a partially separated configuration.
Figure 3B:
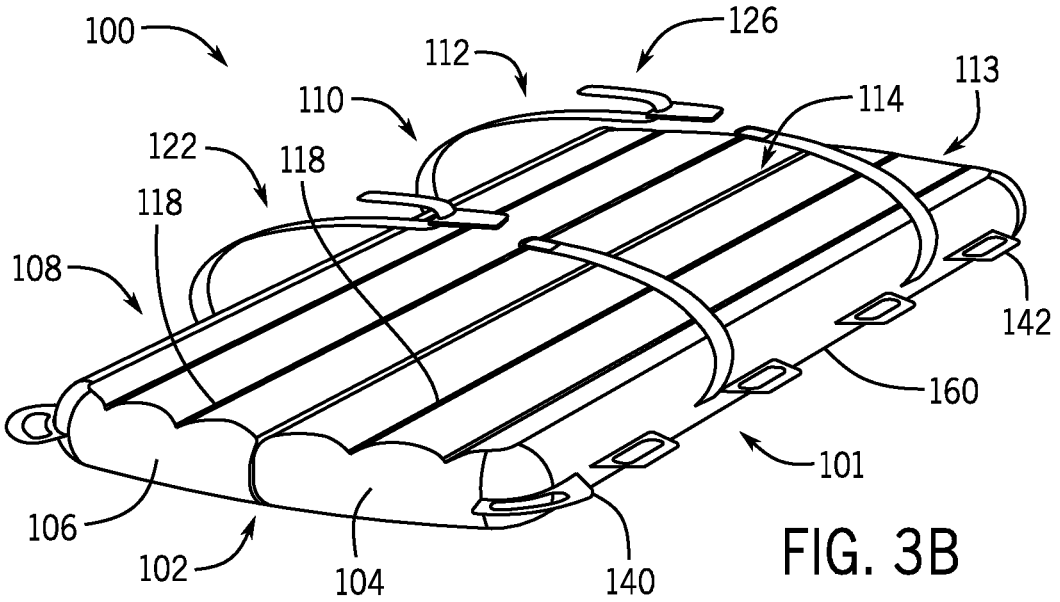
FIG. 3B is an alternate perspective view of the patient transfer system.

FIG. 3A is a perspective view of the patient transfer system 100, in a partially separated configuration with longitudinal sections 102 and 104 detached in proximal (head) region 108 of the patient support 101. FIG. 3B is an alternate perspective view of the patient transfer system 100, e.g., in the substantially unitary material embodiment of FIG. 1B.

As shown in FIGS. 3A and 3B, the patient transfer system 100 includes have a separation or split 102 extending down the middle of the patient support 101. The split 102 typically extends lengthwise along the longitudinal dimension of the patient support 101, for example along the centerline or midline define by the longitudinal axis A of the patient support 101 as shown in FIG. 3, in order to divide the support 101 into two separate, generally symmetric half sections 104 and 106. Alternatively, the split 102 is not necessary defined along to the midline A, other skew and asymmetric separations are also contemplated.

The split 102 extends generally along at least a part or a majority of the length of the inflatable patient transfer support 101, so that the torso and other heavier portions of the patient are disposed above the split 102 dividing the two longitudinal sections 104, 106. As illustrated in FIGS. 3A and 3B, for example, the split 102 extends through a head region or proximal portion 108 of the support apparatus 101 (configured to support a head of the patient), a torso region or mid portion 110 (configured to support the torso or shoulder/back/hip region of the patient), and at least part of the lower body or leg portion 112 (configured to support the lower limbs or legs of the patient).

The patient's head, shoulders, back, hips, and at least a portion of the patient's legs can thus be supported on the top surface 130 of the apparatus 101, across the split 102 dividing the split longitudinal sections 104 and 106. The split 102 and seam structure 118 may terminate at an intact (undivided) transverse section 114 at the distal end sections 112, 113 of the support 101, which are configured to support an area of less total mass of the patient, such as the patient's feet and in some cases a lower portion of the patient's legs.

After the patient transfer system 100 is deflated, the divided sections 104 and 106 of the support bed or device 101 can be separated laterally from one other by medical staff or other caregivers, in order to remove the split sections 104, 106 from beneath the heaviest portions of the patient (such as the patient's head, torso, shoulders, back, hips, and possibly extending up to at least the upper portion of the patient's legs). Then, the intact transverse section 114 at distal end 113 of the patient support 101 can easily be removed from beneath the patient's feet, a region of substantially less body mass, e.g., by sliding the transverse section 114 out along axis A.

Alternatively, the split 102 and seam structure 118 may extend from the proximal region 108 (at the patient's head) through the middle (torso) region 110 and through the distal regions 102 (lower limbs) and 103 (feet). In these configurations, the seam 118 can be completely separated along the entire length of the patient support 101, leaving the longitudinal sections 104, 106 split into two separate portions or halves for removal from beneath opposite sides of the patient. Depending on application, the seam 118 may extend through the transverse section 114, separating section 114 into portions with the longitudinal sections 104, 106, or the transverse section 114 may be absent, with flow ports or apertures provided across the seam structure 118 to provide flow communication between the longitudinal sections 104, 106 (see FIG. 7).

As such, the inflatable patient transfer system 100 can be removed from beneath the patient with little to no additional torso manipulations, or other disturbances to the patient. For example, the inflatable transfer system 100 can be removed from beneath the patient without having to roll the patient from side to side, as is required by existing inflatable transfer devices.

As further illustrated in FIGS. 3A and 3B, the inflatable patient transfer system 100 includes a selectively engaged coupling, e.g., in the form of a releasable seam or strip 118 designed to provide a continuous supporting surface 130 for the patient during inflation and transfer. The releasable seam 118 supports the patient's head and/or mid-section across the split 102 defined between the two longitudinal sections 104 and 106, providing a substantially continuous top surface 130 to support the patient, avoiding discomfort during the transfer process. The seam 118 may also be adapted to control the selective separation of the longitudinal sections 104, 106 from one other. For example, the seam 118 may be configured to at least partially retain the two sections 104, 106 together while inflated for the patient transfer, and to control the amount of force needed to separate the sections 104, 106 after the transfer process is complete.

More generally, the releasable seam or strip 118 of the inflatable transfer system 100 can be configured so that the releasable seam or strip 118 will not separate under pull pressure (or a similar transverse force or tension load), while the patient support device 101 is inflated and during the patient transfer process. Conversely, the releasable seam or strip 118 can be configured to yield and separate under force when the patient support 101 is deflated, for example using a directional seam material that yields under directional force when the patient support 101 is deflated; e.g., a directional force with a vertical component substantially transverse to the seam or strip 118, or substantially transverse or perpendicular (orthogonal) to the plane of the patient support 101.

The seam 118 may be made of various suitable materials, and attached to the system 100 along the split 102 using various methods to achieve these properties. In some embodiments, for example, the releasable seam 118 comprises a releasable adhesive or mechanical attachment feature such as non-tack glue, a hook and loop (e.g., VELCRO) fastener system, or a polymer, cellulose, textile, or tear strip material adapted for a selectively engaged coupling that is sufficiently strong to maintain the sections 104, 106 in abutting relationship when the system 100 is inflated and a patient is supported on the device 101, and which allows the split sections 104, 106 to be easily pulled apart from one another after the transfer by nursing staff, medical staff, or other caregivers.

The releasable seam 118 may extend along part or all of the length of the separation or split 102. The seam 118 may be exposed and visible along one or both of the upper and lower surfaces 130 and 150 of the patient support 101, as shown. In embodiments in which the split 102 extends the entire length of the patient support 101, the seam 118 may temporarily bind or attach the sections 104, 106 together for supporting the patient. The releasable seam 118 may also be configured as a directional or no-gap separation seam, or similar selectively releasable attachment mechanism.

The inflatable patient transfer system 100 may include a securement feature for securing the patient to the support apparatus 101. For example, the system 100 may include one or more adjustable straps 122 for securing the patient to the top 130 of the support 101. The straps may also maintain alignment and positioning of the patient with respect to the support apparatus 101 during inflation of the patient support 101, and during the patient transfer procedure. Existing transfer devices generally use rigid plastic or metal buckles, which can cause discomfort to the patient or operator in certain conditions. In contrast, the straps 122 may formed of flexible textiles adapted for strength and patient comfort, and for ease of use by the operators (e.g., nurses and medical staff, or other caregivers).

Straps 122 may be used to secure the patient to the inflatable support 101 during the transfer. For example, a first strap 122 can be configured to wrap around the chest or torso region of the patient, with a second strap 122 configured to wrap around the lower leg region of the patient, in order to secure the patient to the top surface 130 of the patient support 101. One end of the first strap 122 is attached to the first longitudinal section 104 in the middle or torso region 110 of the support 101, and the other end of the first strap 122 is attached across the patient's body to the middle or torso region 110 of the second longitudinal section 106. Similarly, one end of the second strap 122 is attached to the first section 104 in the lower body or leg region 112, and the other end of the second strap 122 is attached across the patient's lower body or legs to the lower body region 112 of the second section 106.

The straps 122 include an adjustable buckle or coupling 126 to tighten the straps 122 around the patient, in order to secure the patient to the transfer system 100. The straps 122 may each include one or more such adjustable couplings 126 for adjusting the length of the straps 122. Each coupling 126 may be attached to a first segment of the respective strap 122 (such as the segment attached to the first section 104 of the patent support 101), and each coupling 126 may define a connector to receive the second segment of the respective strap 122 (such as the segment attached to the second section 106 of the patient support 101), for example a loop or similar aperture through which the respective end of the strap 122 is passed in order to secure the two segments together about the patient. The end of the strap segment routed through the loop or similar connector element in the adjustable coupling 126 may then be selectively attached to a portion of the strap segment not routed through the aperture, such as via a frictional engagement or a releasable hook and loop fastener system, in order to secure the straps 122 in a desired position around the patient. The adjustable couplings 126 may be made of various sturdy but soft and compliant materials such as compliant plastic elastomers, compliant polymers, woven fabrics, and other textile materials.

The system 100 may be provided in a skin friendly format, with the top surface 130, bottom surface 150, and other exterior surfaces of the patient support 101 formed of a material suitable for direct contact with the patient's body, clothing and skin. Alternatively, the exterior surface materials may be formed of a non-breathable, non-absorbent and substantially impervious surface material—such as a nylon coated PVC (polyvinyl chloride) or TPU (thermoplastic polyurethane) material, or other suitable polymer, which may be used in conjunction with a skin friendly removable (single-use) pad or linen component disposed between the top surface 130 of the device 101 and patient to prevent skin contact, skin shear or friction injury during removal.

To facilitate lateral separation of the first section 104 and the second section 106, the inflatable patient transfer system 100 may include one or more tables or handles attached to the first section 104 and the second section 106 of the patient support device or apparatus 101. The system 100 may include one or more separation handles or tabs 140 attached to the first section 104 and to the second section 106, with the tabs or handle structures 140 adapted for grasping by different operators including nursing and medical staff, or other care providers. The handles or tabs 140 may be attached to the head region 108 of the patient support 101. In some embodiments, the handles or tabs 140 may be attached to respective corners of the first and second longitudinal sections 104, 106, near the start or origination of the split 102 at the proximal end 108 of the support 101, in order to facilitate separation of the split sections 104, 106 from one other after completion of the patient procedure and transfer, upon deflation of the air-bearing patient support 101.

To facilitate moving a patient lying on the top surface of the patient support 101 with patient transfer system 100, the system 100 may also include one or more positioning handles 142 attached to opposing sides of the patient support 101. For example, the system 100 may include multiple handles 142 attached to each side of the outer perimeter of the patient support 101. The system 100 may also include handles 142 located in one or more of the head region 108, the torso region 110, the lower body or leg region 112 and the foot region 113, to facilitate movement of the patient lying on the top surface 130 of the patient support 101.

The inflatable patient transfer system 100 can also include one or more fill ports or inlets 146 for inflating the air-bearing patient support 101. The fill ports 146 may be located on an end of the system 100, e.g., at the distal end 112 or 113 proximate the transverse section 114 of the system 100, such that air entering into the system 100 flows into both longitudinal sections 104, 106 of the patient support 101 at substantially the same time, thereby facilitating an even inflation of the system 100 while a patient is lying on the top surface 130.

In the embodiments of FIGS. 3A and 3B, for example, one or more fill ports 146 may be disposed in or adjacent a transverse section 114 of the support 101, or otherwise located in the distal end 112 or 113 of the support 101 (in the lower leg or foot region of the patient's body), generally opposite the start of the split 102 at the proximal end 108 (in the region of the patient's head). In one particular example, the system 100 includes three fill ports 146, one of which is located along the centerline or midline A of the patient support 101, aligned with the split 102 between the longitudinal sections 104 and 106, and the other two of which are located at opposite sides or corners of the transverse section 114. Alternatively, the patient transfer system 100 may include one, two, three, or more fill ports 146, positioned to provide airflow to the longitudinal sections 104, 106 of the inflatable patient support 101, and any transverse section 114.

The inflatable patient transfer system 100 may include a plurality of internal baffles 160 that direct air flowing through the interior of the patient support 101. Each baffle 160 may be a formed of a substantially oblong or rectangular sheet of polymer or other suitable material, with a top edge attached to the inside of the upper surface 130 of the patient support 101, and a bottom edge attached to the inside of the lower surface 150 of the patient support 101. One or more baffles 160 may extend transversely with respect to the centerline A of the system 100, in each of the longitudinal sections 104 and 106, and in the transverse section 114. As illustrated in FIGS. 1-3, multiple baffles 160 may extend transversely (e.g., perpendicularly) to the split 102 within the core areas 132, 154 of the upper and lower surfaces 130, 150 of the system 100.

Removable Sheet Applications

Figure 4A:
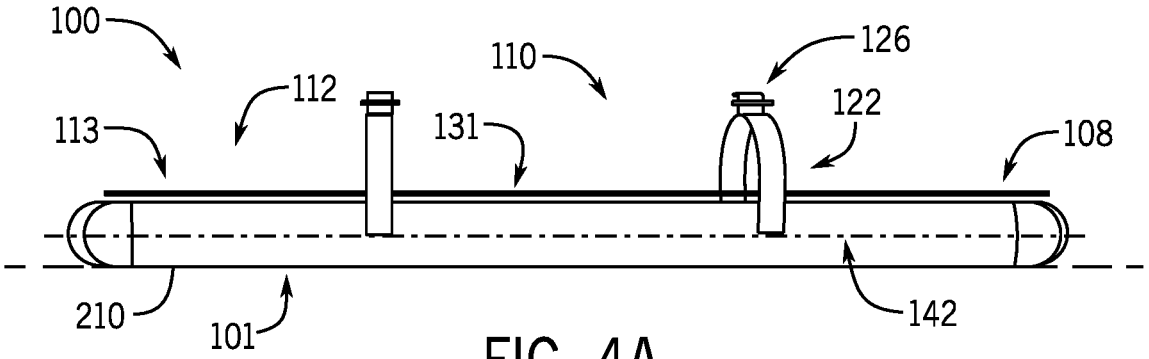
FIG. 4A is a side view of the patient transfer system, with a removable transfer sheet.
Figure 4B:
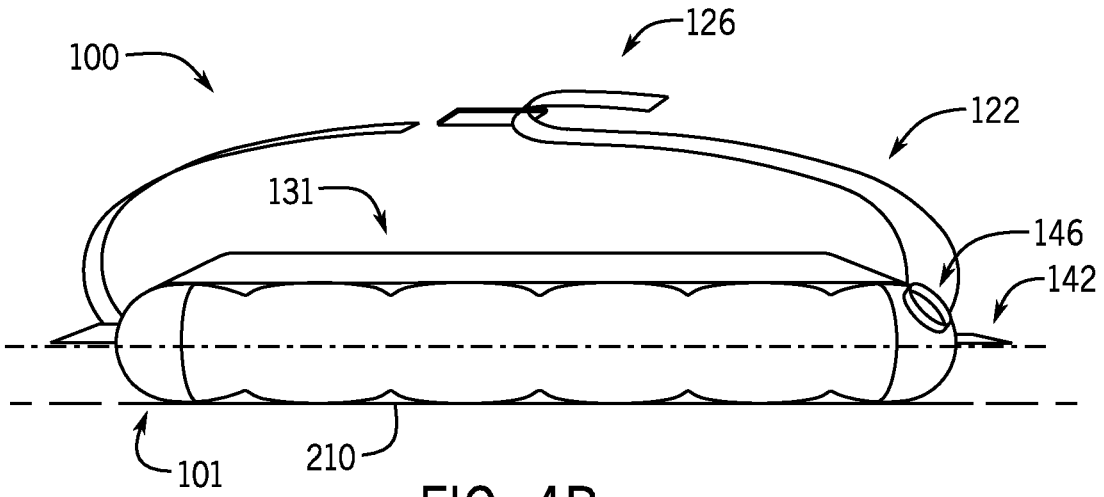
FIG. 4B is end view of the patient transfer system and removable transfer sheet.

FIG. 4A is a side view of the patient transfer system 100, with a removable transfer sheet 131. FIG. 4B is end view of the patient transfer system 100, also showing the removable transfer sheet 131.

As shown in FIGS. 4A and 4B, the air-bearing patient support 101 is inflated for use in transferring a patent or body along one or more transfer surfaces 210, e.g., between a hospital bed and a gurney or between a bed or gurney and an operating table or examination table. Transfer sheet components 131 suitable for use with system 100 include, but are not limited to, single-use transfer sheets as described in U.S. Pat. No. 9,101,521 to White and Emerson, SYSTEMS, METHODS AND TRANSFER SHEETS FOR TRANSFERRING PATIENTS, which is incorporated by reference herein. These configurations of a patient transfer system can provide substantial ergonomic benefits for health care workers, including increased ease of patient transfer with reduced risk of injury due to stress and strain, even for relatively large-statured, heavy or bariatric (e.g., obese) patients or bodies. For a patent weight of about 100 lbs (440-450 N), for example, the pull force needed in a draw sheet transfer is about 70-75 lbs (310-340 N). For other, heavier patients, the required pull forces may exceed the recommended limits for two or more caregivers in typical draw sheet transfer, even when working together in a coordinate fashion. For example, a disclosed design has been used to transfer patients with weights of up to about 490-500 lbs (2150-2250 N), with BMI of up to about 53.

Referring to FIGS. 3A, 3B and compared to FIGS. 4A and 4B, the upper surface 130 of the air-bearing patient support 101 can be configured to enhance material-to-skin interaction, or a removable pad or linen component 131 can be provided between the device 101 and the patient. The upper surface 130 or removable sheet component 131 may have absorption characteristics to contain fluids (e.g., blood and other bodily fluids) that are present or produced during a medical procedure and subsequent patient transfer. In some embodiments, an absorbent core or middle area 132 of the upper surface 130 may be provided, e.g., recessed relative to a complementary peripheral border area 134, so that fluids drain or are directed into the core absorbent area 132.

The core area 132 may be configured to absorb any such fluids produced during the procedure and transfer, whereas the peripheral border area 134 may be configured to be relatively impermeable, and to direct fluids toward the core area 132 for absorption. Because the system 100 may be provided in a single-use or disposable format, any fluids absorbed by the system 100 can be disposed of in a sanitary manner, according to accepted medical protocols. The system 100 may allow for re-use, as well as single-patient use. In various embodiments, the top surface 130 of the patient support apparatus 101 may be substantially impervious, and a removable absorbent sheet can be disposed on the top surface 130. In various embodiments, a compatible disposable cover may be disposed over the patient support apparatus 101 such that the apparatus 101 can be re-used with a new disposable cover.

Patient Support and Seam Construction

Figure 5A:
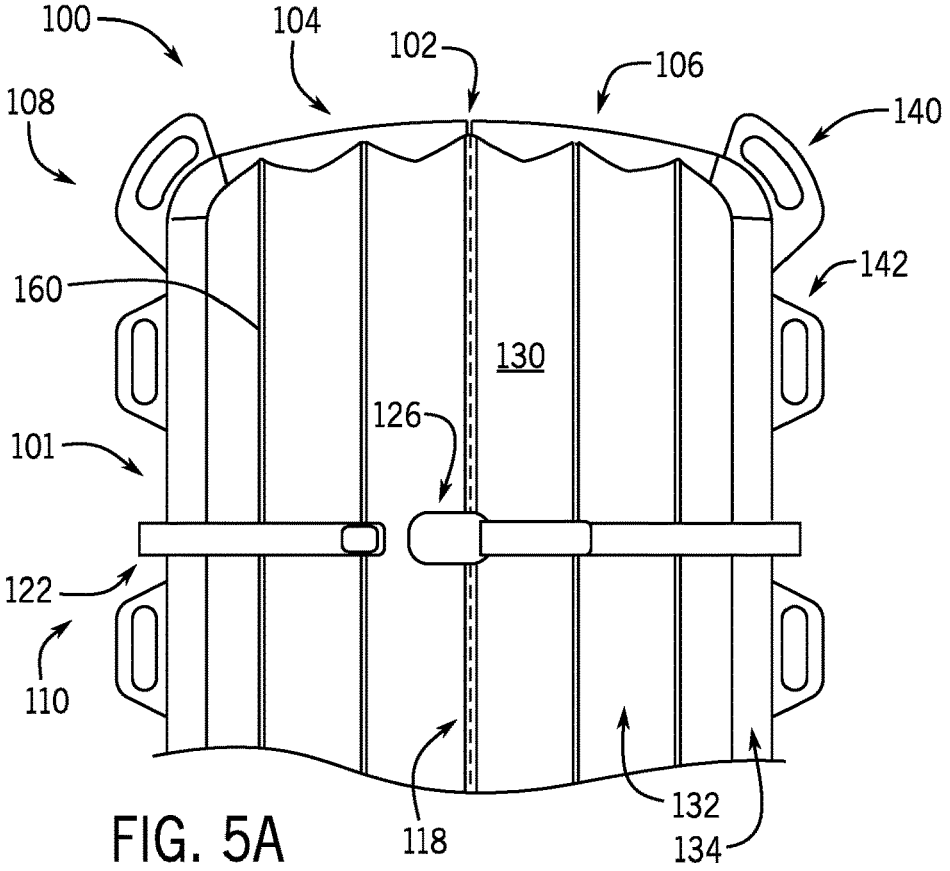
FIG. 5A is a plan view of the patient transfer system, in the head and torso region.
Figure 5B:
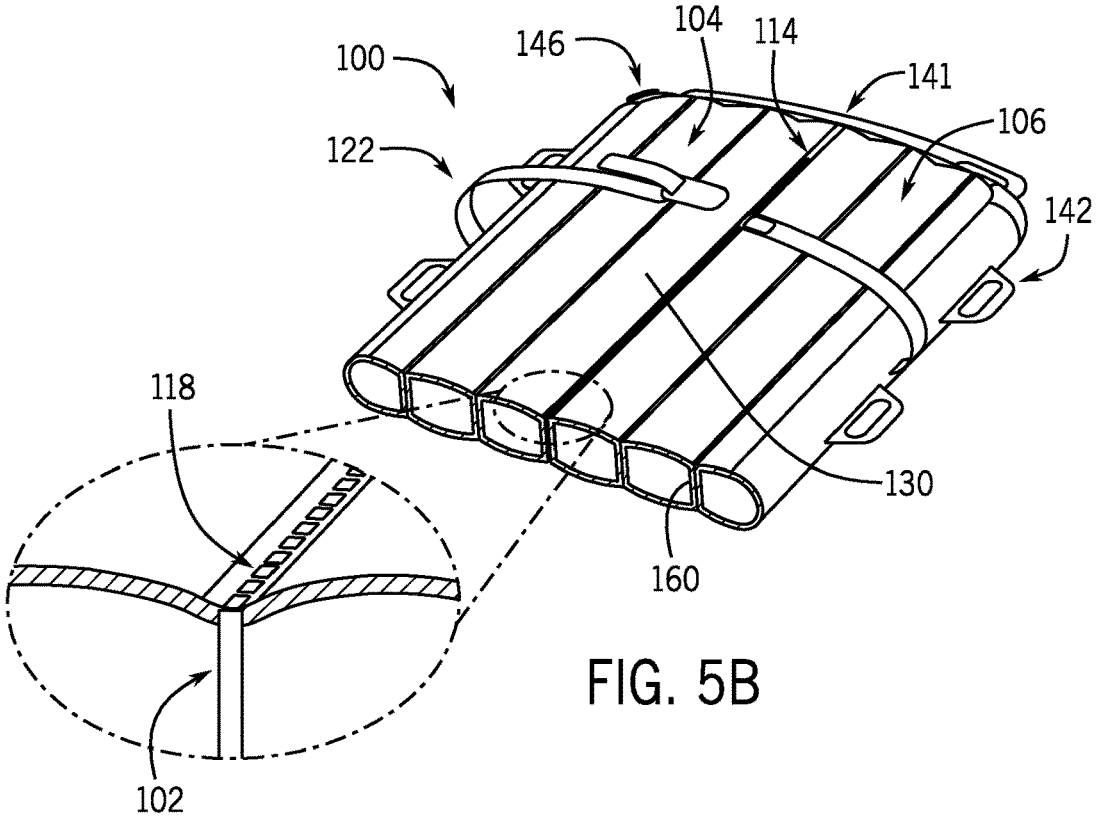
FIG. 5B is a perspective section of the patient transfer system, showing internal structure.

FIG. 5A is a plan view of the patient transfer system 100, showing the head and torso regions 108, 110. FIG. 5B is a perspective section view of the system 100, showing internal structures including baffles 160 and a detail view of the releasable seam 118.

As shown in FIGS. 5A and 5B, the releasable seam 118 extends from the head region 108 of the patient support 101 toward the torso region 110. Separation handles or tabs 140 can be provided in the head region, in order to separate the longitudinal sections 104, 106 after the patient transfer is complete.

The releasable seam or strip 118 is configured to maintain a coupling between the longitudinal sections 104, 106 against the transverse force or tension loading experienced upon inflation of the patient support 101, and to yield so that sections 104, 106 can be separated when the patient support 101 is deflated. Depending on application, the seam 118 can thus be formed of a range of suitable materials adapted for selectively engaging and maintaining the longitudinal sections 104, 106 together in an abutting relationship when the patient support device 101 is inflated, and which allows the adjacent sections 104, 106 to be detached and pulled apart from one another after the transfer by nursing staff, medical staff, or other caregivers.

For example, a perforated seam 118 can be formed of a substantially continuous material across the adjacent sections 104 and 106, or a directional release material or tear strip can be used, which yields under directional force with a sufficient vertical component; that is, substantially transverse to the seam or strip 118, and substantially transverse or perpendicular to the plane of the patient support 101. In perforated seam embodiments, the releasable seam 118 can be formed of the same substantially continuous and integral material as the longitudinal sections 104 and 106, extending longitudinally along the upper surface 130 of the patient support 101.

In some embodiments, the seam 118 can be exposed and visible along the upper surface 130 of the patient support 101, above the gap or separation 102 between the longitudinal sections 104, 106. Alternatively, the seam 118 can extend down into the vertical separation 102, in order to define a vertical web attachment structure between the longitudinal sections 104, 106.

Air Source Couplings and Adapters

Figure 6A:
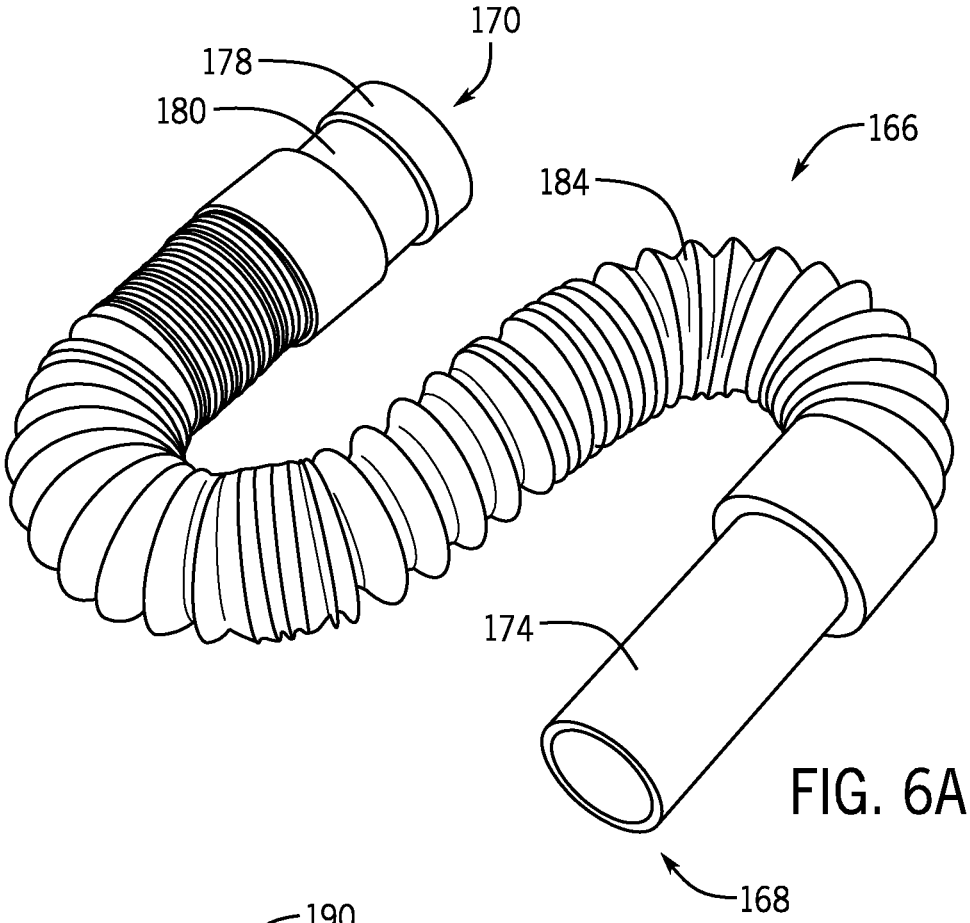
FIG. 6A is a perspective view of a flow coupling for the patient transfer system.

FIG. 6A is a perspective view of a flow coupling or hose 166 for an air-bearing patient transfer system. Air can be supplied to the interior of the patient support via a blower or other air supply coupled to one or more of the fill ports or inlets.

Figure 6B:
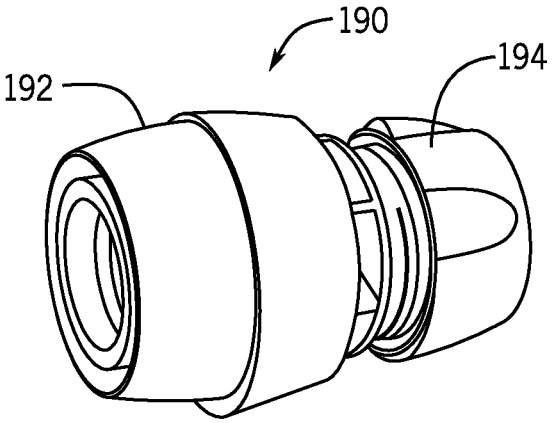
FIG. 6B is a perspective view of a flow coupling adapter for the patient transfer system.

FIG. 6B is a perspective view of a flow coupling adapter 190 for us in coupling a blower or other source of compressed air to the inlet port on the patient support device, e.g., using a hose or similar flow structure 166 as shown in FIG. 6A. FIG. 6B is a perspective view of an alternate flow adapter 190.

Figure 6C:
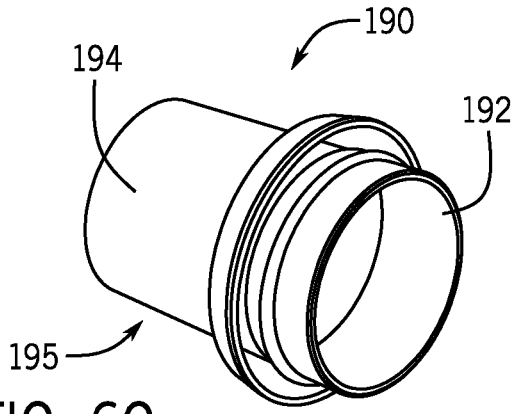
FIG. 6C is a perspective view of an alternate flow coupling adapter.

Referring to FIGS. 6A, 6B and 6C, the patient transfer system may include an air hose 166 that can be attached to any of the fill ports of the patient support, e.g., at a first end 168, and to a blower or compressed air source on the other end 170. The first end 168 can be adapted for attachment to one or more fill ports 146 on a patient support 10 as described herein, for example using a tubular or conical coupling member 174 with a substantially circular cross-sectional shape that can be inserted into a selected port 146, and be secured with a snap, ring, hook-and-loop attachment, or other selective mechanical coupling and sealing arrangement. The coupling section 174 may taper inwardly approaching the terminal end 168 from the hose section 184, in order to facilitate insertion into variously-sized fill port openings 146. In some embodiments, the coupling section 174 is frustoconical.

The supply coupling end 170 of the air hose 166 can be adapted for attachment to a blower or other external air supply, e.g., with a cylindrical end portion 178 having an annular recessed engagement feature 180 aft of the end portion 178. The couplings 174 and 178/180 may be formed as integral or discrete coupling components on each end of the expandable hose section 184, and can interchanged without loss of generality.

The collapsible section 184 of the hose 166 is expandable to accommodate different lengths, suited for connecting the air supply to a selected fill port 146 on the patient support 101. The air hose 166 may be pre-attached during manufacture and stored with the patient support 101, or attached to the patient support 101 at the time of use. Thus, the air hose 166 may be reusable, or provided in a disposable format for single-use applications in combination with the air-bearing patient support 101 and other disposable components of patient transfer system 100.

In single-use or disposable embodiments, the hose 166 may be formed of paper, nylon, fabric, or other suitable polymer or textile materials, which are expandable and collapsible in both length and diameter to accommodate compact storage with the air-bearing patient support 101. In these embodiments, the coupling 174 may take the form of a pre-attached or pre-sewn connection to the air-bearing support apparatus 101, e.g., with the first end 174 of hose 166 sealed to a selected port 146. The second end 180 of the hose can also be provided in collapsible form, and adapted for coupling to a blower or other compressed air source using a friction fit or compressive ring or band sealing mechanism.

In some of these embodiments, the hose 166 can be adapted to be compressed or folded and tucked away for substantially flat storage with the air-bearing patient support 101, so that hose section 184 is not extended until desired for connection to an air source. At the time a patient transfer is desired, the coupling end 180 of the hose 166 can be unfolded or pulled out and attached to a blower or other air source for use This contrasts with prior art designs, where the hose 166 can be heavy and cumbersome, and may create a tangling hazard.

The inflatable patient transfer system 100 may also include a hose coupler or adapter 190 to facilitate coupling of various blowers and air supply systems to a selected fill port 146, either via the hose 166 provided with patient transport system 100, or using another existing hose component. Referring to FIGS. 6B and 6C, for example, the system 100 may include an adaptive hose coupler 190 designed to interface between one or more ports 146 on the air-bearing patient support 101 and a third-party supply hose system, or between the hose 166 supplied with system 100 and the outlet of a third-party blower or air supply.

As illustrated in FIG. 6B, the hose couple or adapted 190 may be configured for coupling an existing hose 166 to the port or vent 146 of the patent support device 101, and for coupling the hose 166 to a particular blower or air supply component. As illustrated in FIG. 6C, a universal hose coupler or adapter 190 may provide a first interface 192 adapted for coupling to a port 146 on the air-bearing patient support 101, and a second interface 194 configured for coupling to a variety of different hose systems, e.g., using a compressive hose fitting. Alternatively, the first interface 192 can be adapted for coupling to the end 170 of a hose 166 that is supplied with the patient transport system 100, e.g., with the other end 168 of the hose 166 attached to a port 146 on the air-bearing patient support 101, as described above. In these examples, the second interface 194 can be adapted for coupling either to another hose component or to the outlet of a suitable blower or other compressed air source, which may be provided in either a dedicated (customized) format, or by a third-party (generic) vendor.

In custom embodiments, the adapter 190 may have simplified interfaces 192, 194 for coupling the end 170 of a hose 166 supplied with the patient transfer system 100 to the outlet of a selected blower or air supply, or for coupling one or more ports 146 to a selected external hose system configured to provide compressed air. Alternatively, one or more custom hose adapters 190 may be provided for using system 100 with a corresponding range of specifically identified or preselected blowers, air supplies, or hose systems. In additional embodiments, the adapter 190 may include an internal or integral compressed air or expanding gas source 195, e.g., an internally or externally-powered blower, a compressed air or carbon dioxide cartridge, or other suitable source of expanding gas.

Applications

An air-bearing patient transfer system 100 or support apparatus 101 can be used to transfer a patient across one surface to another surface (e.g., from a medical stretcher or gurney to a hospital bed or operating table, or vice-versa). The system 100 may be positioned on the first surface in a deflated state, and a patient may be disposed on top surface 130 of the deflated patient support 101 in a supine position (lying on the back), or alternatively in a prone position (lying on the front). One or more straps 122 and adjustable couplings 126 can be used to secure the patient to the system 100. The patient support 101 can then be inflated beneath the patient, e.g., with a blower or similar air source.

The air supplied to the patient support 101 is directed through multiple holes 152 on the bottom surface 150, in order to at least partially support the apparatus 101 and reduce friction while sliding the patient from one surface to another, supported on system 100. After the patient is transferred, the support 101 may be deflated and easily removed from beneath the patient, while the patient remains in a substantially stationary position (e.g., lying on their back, without rolling the torso from side to side).

The main body of the air-bearing patient support 101 includes a split or separation structure 102 to enable easy removal of the longitudinal sections 104 and 106 from beneath the patient. More specifically, the split 102 extends lengthwise along the length of the patient support 101, and divides a substantial length of the support 101 into two separate longitudinal sections 104, 106. The longitudinal sections 104, 106 are coupled together by a directional seam or similar selective engagement 118 during transfer of the patient from one surface to another surface. After transfer, the system 100 may be deflated while supporting the patient, and the sections 104 and 106 can be separated along the split 102 via the releasable seam 118.

Upon deflation, the straps 122 may be separated such that the patient is no longer secured to the deflated air bed or support device 101. The releasable seam 118 can be manipulated to detach the two longitudinal sections 104, 106, e.g., in at the proximal end 108 in the patient's head region, and the sections 104, 106 can be pulled in opposite lateral directions relative to each other, in order to remove the sections 104, 106 from beneath the patient. In this manner, the system 100 can be removed from beneath the patient without rolling the patient to one side or another. In embodiments in which the patient support 101 includes an intact (un-split) transverse section 114, the deflated transverse section 114 can also be removed without requiring manipulation of the patient's torso, e.g., by removing the longitudinal sections 104, 106 to opposites sides of the patient's head and torso in the proximal and middle regions 108 and 110, and sliding the transverse section 114 from beneath the patient's lower legs or feet, in one or both of distal regions 112 and 113.

A suitable patient transfer system 100 may comprise one or more of a first inflatable section 104 and a second inflatable section 106 disposed adjacent the first inflatable section 104, with the first and second inflatable sections 104, 106 configured for supporting a patient. A selective engagement or releasable seam 118 can be provided between the first and second inflatable sections 104, 106, e.g., with the releasable seam 118 defined across a split 102 extending longitudinally between the first and second inflatable sections 104, 106 through a head region 108, a body or torso region 110, and at least part of a lower body (leg) region 112 of the patient. The first section 104 and the second section 106 are laterally separable along the split 102 for removal of the apparatus 101 without rolling the patient to either side.

The split 102 can terminate at a transverse section 114 of the device 101, extending between the first and second inflatable sections 104, 106 in flow communication therewith, e.g., with the transverse section 114 configured to support the patient in the region of the feet 113. For example, the split 102 can extend along a medial axis A of the device 101, such that the first section 104 and the second section 106 are similar or substantially identical, with symmetry about the medial axis A.

The first and second inflatable sections 104, 106 are in flow communication with other (e.g., via the transverse section 114), for simultaneous inflation by an external or integrated air source coupled to one or more ports or inlets 146. An expandable air hose 166 can be adapted to attach the air-bed or patent support 101 to the air supply for inflating the first and second sections 104, 106, e.g., with the air hose 166 being configured for a single-use application in combination with the air-bearing patient support 101. A coupling adapter 190 can also configured to interface the air hose with one or more different models of the external air supply, or with an integrated or internal adapter and compressed air or gas system 190.

The patient transfer system 100 may include a releasable seam 118 extending along the split 102 defined between the first and second inflatable sections 104, 106, e.g., with the seam 118 configured for selective attachment and separation of the first and second inflatable sections 104, 106. Depending on application, the seam 118 may extend along a complete length of the split 102, and be configured to provide a continuous support surface for the patient, e.g., a continuous upper support surface 130 extending across the split 102 between the first and second sections 104, 106 after inflation of the air-bearing bed device 101.

The patient transfer system 100 may also include one or more adjustable straps 122 attached across the first and second inflatable sections 104, 106, with the adjustable straps 122 configured to secure the patient to the air-bearing support 101. A core absorption area 132 can be defined on the upper surface 130 of the apparatus 101, in order to absorb fluids, e.g., with a border area or raised feature 134 surrounding the core area 132, where the border area 134 is raised relative to the core area 132 in order to direct fluids towards the absorptive elements in core area 132.

ADDITIONAL EXAMPLES

Figure 7:
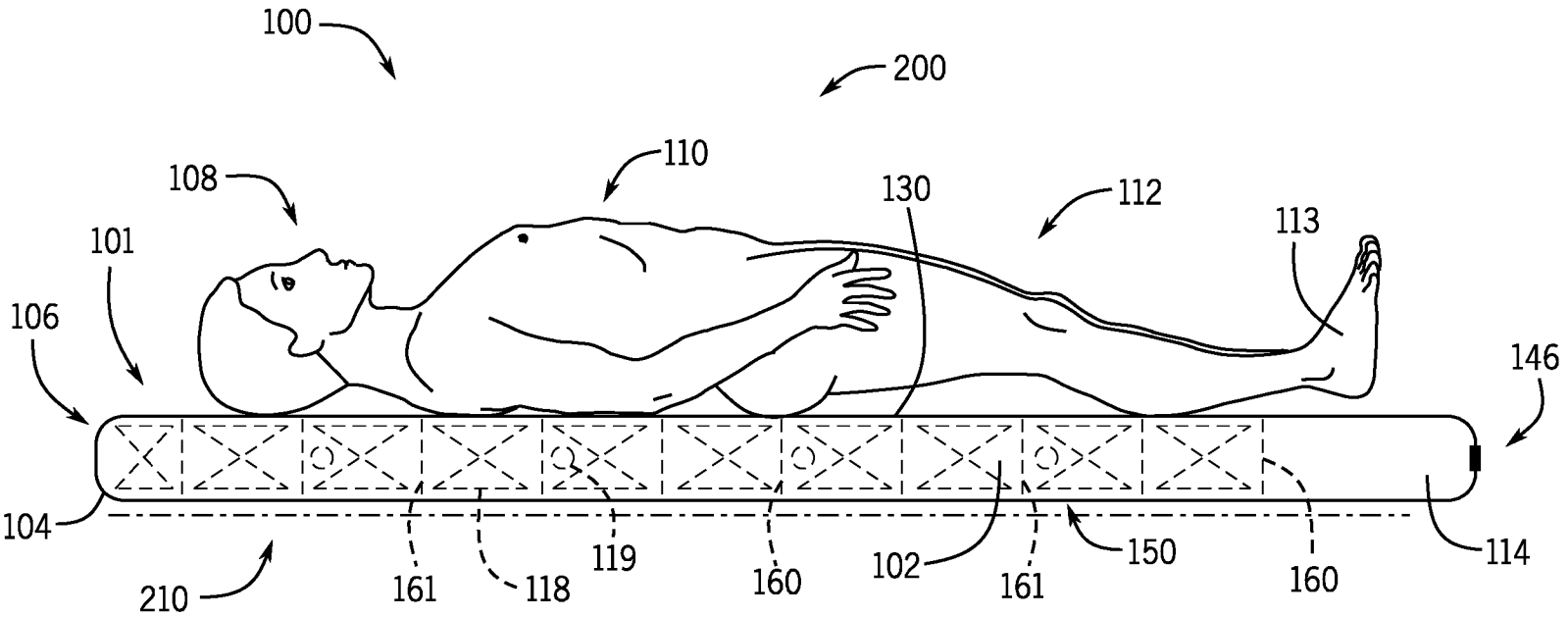
FIG. 7 is a side section view of the patient transfer system.

FIG. 7 is a section view of a patient transfer system 100, as described herein. As shown in FIG. 7, the system 100 include an air-bearing patient support or "air bed" apparatus 101 with first and second longitudinal sections 104 (front) and 106 (back). A port or inlet 146 is provided in flow communication with the first and second longitudinal sections 104, 106, e.g., via the transverse section 114, and configured for inflation of the air-bearing support 101 for transfer of the patient (or other body) 200 across one or more surfaces 210 (e.g., between an operating or examining table and a bed or gurney, or from one bed or gurney to another, etc.).

A selectively engaged coupling or seam member 118 extends along the separation or split structure 102 defined between the first and second longitudinal sections 104, 106 (see FIG. 3). The selective coupling or seam 118 is configured to attach the first and second longitudinal sections 104, 106 together for transfer of the body on the air-bearing support 101, and to at least partially detach the first and second longitudinal sections 104, 106 for separation and removal.

Depending on application, the selective coupling may comprise a directional or selectively releasable seam 118 extending longitudinally between the inflatable sections 104, 106 of the air-bearing patient support 101, from a proximal end region 108 (e.g., in the head region of the patient's body) toward a distal end 112 or 113 (e.g., in the lower leg or foot region of the patient's body). Alternatively, the orientation of the patient may be reversed, or another body 200 can be transported.

The releasable seam 118 can be configured to detach the longitudinal sections 104, 106 at the proximal end 108, and to separate the sections 104, 106 longitudinally from the proximal end 108 toward the distal end 112 or 113. For example, the releasable seam 118 may extend vertically between the upper and lower surfaces 130, 150 of the patient support 101, forming a web or similar attachment structure along the split 102 between the front and back longitudinal sections 104, 106, in order to maintain attachment of the sections 104, 106 for transfer of the body 200 upon inflation of system 100.

The seam is adapted to detach the longitudinal sections 104, 106 upon deflation of the air-bearing support 101, and application of a manual separation force. For example, a manual pulling force or tensile load can be applied via one or more separation handles 140, in order to separate the sections 104, 106 in a direction perpendicular to the split 102 as described above, or the sections 104, 106 can be separated by applying a suitable separation or transverse "ripping" force; e.g., transverse to split 102 and transverse to the plane of patient support 101.

The selective coupling can thus be configured for detachment of the longitudinal sections 104, 106 at the proximal end 108, for separation of the longitudinal sections 104, 106 to opposing sides of the body 200 along the split 102 or directional seam 118, and for removal of the air-bearing support 101 from beneath the body 200 without additional manipulation of the patient 200 in the torso region 110 (that is, without requiring a further rolling operation on the patient 200). A transverse section 114 of the air-bearing patient support 101 is provided in flow communication with the first and second longitudinal sections 104, 106, e.g., where the selective coupling or seam 118 extends between the first and second longitudinal sections 104, 106 from a middle portion of the transverse section 114 to the proximal end 108 of the patient support 101.

One or more ports or inlet couplings 146 may be disposed in the air-bearing patient support 101, e.g., in the transverse section 114, and provided in flow communication with the first and second longitudinal sections 104, 106 (e.g., with from port 146 via the transverse section 114). For example, suitable ports 146 may comprise an inlet coupling for an external blower or other compressed air supply, which is configured for inflation of the air-bearing patient support apparatus 101.

An air hose 166 (FIG. 4) can be attached to the inlet coupling 146, e.g., with the air hose 166 adapted for directing airflow from the external air supply to the patient support 101 in a single-use application of the transfer system 100. Suitable air hoses components 166 include an expandable or collapsible flow section 184 adapted for directing the airflow, where the collapsible flow section 184 is configured for substantially flat storage in combination with the air-bearing patient support 101, and for extension from the air-bearing patient support 101 for use in inflation. Alternatively, an integral air supply and coupling 190 can be coupled to the port 149, with the integral air supply 190 adapted for inflation of the air-bearing support 101 in a single-use application of the transfer system 100.

The selective coupling may comprise a longitudinal seam structure 118 configured to define a substantially continuous top surface 130 of the air-bearing support 101, across the seam 118 and split 102 defined between the first and second longitudinal sections 104, 106. Thus, the body 200 can be supported on the substantially continuous top surface 130, upon inflation of the air-bearing support 101.

A plurality of internal baffles 160 can be disposed in the one or both of the first and second longitudinal sections 104, 106 (or within the transverse section 114). As shown in FIG. 7, for example, the baffles 160 extend vertically between bottom surface 150 and the top surface 130 of the air-bearing support 101, in order to provide structural integrity when inflated. The baffles may also extend transversely with respect to the longitudinal sections 104, 106 (and with respect to the seam 118), and may further comprise one or more ports or apertures (holes) 161 adapted to admit longitudinal airflow across the baffles 160 through each section 104, 106, 114, for inflation of the air-bearing support 101. Alternatively, the baffles 160 may extend longitudinally through on or both sections 104, 106, e.g., as shown in FIG. 5B.

The selective coupling may define a selectively detachable or releasable seam 118, configured for separation and removal of the first and second longitudinal sections 104, 106 upon a single-use transfer application of the air-bearing support 101. The entire system 100, or a component thereof, can then be configured for sanitary disposal, after the transfer operation and removal from beneath the patient's body 200. One or more apertures 119 may disposed along the detachable or releasable seam 118, and configured for transverse airflow across the split 102 between the first and second longitudinal sections 104, 106, e.g., upon inflation of the air-bearing support 101.

In some embodiments of the patient transfer system, the selective coupling comprises a perforated seam 118 defined between the first and second longitudinal sections 104, 106. For example, the perforated seam 118 may extend along the top surface 130 of the inflatable patient support apparatus 110, and be formed of a substantially same material as the sections 104, 106. Similarly, the first and second longitudinal sections 104, 106 may be formed of a substantially same and continuous material with the transverse section 114, and the other components of the patient support 101, with the substantially continuous material 118 extending across the gap or split 102 to define the perforated seam 118 between sections 104 and 106.

Alternatively, the split 102 and seam structure 118 may extend through the transverse section 114, for complete separation of the patient support 101 into two separate split sections 104, 106, which can be independently removed from beneath opposite sides of the patient 200. Depending on application, the transverse section 114 may be absent, or flow apertures 119 can be provided across the seam structure 118 extending through the transverse section 114, in order to provide flow communication between the longitudinal sections 104, 106.

A plurality of flow apertures 152 can also disposed on the bottom surface 150 of the air-bearing support (see FIG. 2), with the apertures 152 configured for airflow between the air-bearing support 101 and one or more surfaces 210 across which the transfer of the body is accomplished. Thus, the patient can be at least partially supported on the airflow, reducing friction between the bottom 150 of the air-bearing patient support 101 and the transfer surface or surfaces 210, in order to accomplish the patient transfer more easily and with less risk of discomfort or injury to either the patient 200 or the medical workers (or other caregivers) assisting in the transfer.

One or more adjustable straps 122 can be provided, e.g., extending transversely across the patient 200 between the first and second longitudinal sections 104, 106 of the air-bearing support 101. The straps 122 can be attached to a perimeter of the air-bearing support 101, or extend around the bottom surface 150 of the support 101, and may include an adjustable clasp, buckle or similar coupling system 126 for securing the body 200 to the top surface 130 during the transfer process.

One or more handles 142 can also be disposed along a periphery of the air-bearing support 101, with the handles 142 configured for pulling the air-bearing support 101 across one or more surfaces, to accomplish the transfer of the body 200. Additional handles or pulling tabs 140 can also be provided to detach the sections 104, 106, and to separate the sections 104, 106 along the seam 118 (e.g., after the transfer is finished, and the patient support 101 is deflated).

Depending on application, the air-bearing support or bed 101 can include a proximal portion configured to support a head region of the patient's body (proximal section 108), a medial portion configured to support a torso region of the patient's body (medial section 110), and a distal portion configured to support a lower region of the patient's body (distal section 112), respectively. The distal portion can be configured to support the patients' lower limbs or legs, and also to support the patient's feet (distal section 113).

The selective coupling or seam 118 can configured to attach the longitudinal sections 104, 106 together to support the head region and the torso region of the body 200 in the proximal and medial portions 108 and 110, respectively, and to detach the longitudinal sections 104, 106 in the proximal portion 110, toward the patient's head. The selecting coupling or seam 118 can also be configured to separate the longitudinal sections 104, 106 in a direction proceeding from the proximal portion or head (section 108) through at least the medial portion or torso (section 110), for removal of the air-bearing patient support apparatus 101 from beneath the body 200, without rolling the torso or otherwise manipulating the patient from side to side.

For example, the transfer system 100 may comprise an air-bearing patient support 101 having a transverse section 114, with first and second longitudinal sections 104, 106 extending from the transverse section 114. A port 146 can be provided in flow communication with the first and second longitudinal sections 104, 106, e.g., via the transverse section 114, and the port 146 can be configured for inflation of the air-bearing patient support 101 for transfer of a patient 200 on the top surface 130.

A plurality of flow apertures or holes 152 can be disposed on the bottom surface 150 of the air-bearing patient support 101, with the flow apertures 152 configured for airflow from the interior of the air-bearing patient support 101 during the transfer. Thus, the patient 200 and support apparatus 101 are at least partially supported on the airflow, substantially reducing friction between the bottom surface 105 of the support 101 and the surface or surfaces 210 across with the transfer is accomplished.

A selectively engaged seam 118 can be provided, extending between the first and second longitudinal sections 104, 106 from a proximal end 108 of the air-bearing support 101 toward a distal end 112 or 113. The selectively engaged seam 188 can be configured to maintain attachment of the longitudinal sections 104, 106 for transfer of the body 200 upon inflation on the air-bearing support, and for selective detachment of the longitudinal sections at the proximal end for separation and removal upon deflation of the air-bearing support.

The proximal end 108 of the air-bearing support 101 can be adapted to support the head region of the patient 200, with the selectively engaged seam 118 configured for separation of the longitudinal sections 104, 106 from the proximal end 108, proximate the head region of the patient 200, and through at least a torso region of the patient in a medial portion 110 of the support apparatus 101. The seam 118 can be further configured for removal of the longitudinal sections 104, 106 to opposing sides of the patient 200, absent further manipulation of the patient's torso region in the medial portion 110 of the support 101.

The selectively engaged seam 118 can also be adapted to define a substantially continuous top surface 130 of the air-bearing patient support 101, with the seam 118 extending across the split 102 between the first and second longitudinal sections 104, 106. For example, the first and second longitudinal sections 104, 106 may be formed of a substantially continuous material, where the substantially continuous material also defines the perforated seam 118 extending longitudinally between the sections 104, 106. Upon completion of the patient transfer, the seam 118 is configured for separation and removal of the longitudinal sections 104, 106. Following a single-use transfer application of the air-bearing support 101, the entire system 100, or a disposable cover disposed over the support 101, may be configured for sanitary disposal.

A plurality of internal baffles 160 can be provided, e.g., extending transversely within one or both of the first and second longitudinal sections 104, 106, and vertically between the bottom and top surfaces 150, 130 of the air-bearing support 101. In this arrangement, the baffles 160 can be configured to provide structure support upon inflation of the support 101, while admitting longitudinal airflow along each of the sections 104, 106.

In some examples, one or more straps 122 extend transversely across the longitudinal sections 104, 106 of the air-bearing patient support 101, for securing the patient to the top surface 103. The apparatus can also include one or more handles 142 disposed along a periphery of the support bed 101, in order to accomplish the transfer by pulling the patient 200 from one surface 210 to another.

An absorbent layer portion 132 can be provided or disposed on the top surface 130 of the air-bearing patient support apparatus 101, with the absorbent layer 132 adapted for absorption and disposal of fluids together with the air-bearing apparatus 101, after the transfer is complete. A border 134 may be disposed about the absorbent layer portion 132, e.g., a raised border 134 adapted to direct the fluids to the absorbent layer portion 132. Alternatively, the top surface 130 of the patient support apparatus 101 may be substantially impervious, and a removable absorbent sheet can be disposed on the top surface 130.

Figure 8A:
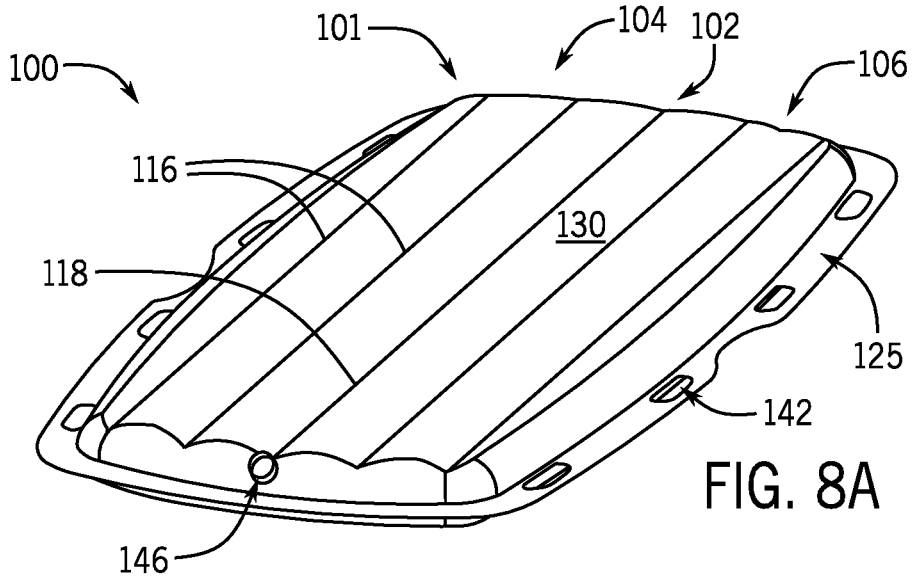
FIG. 8A is a perspective view of the patient transfer system, with longitudinal baffles.
Figure 8B:
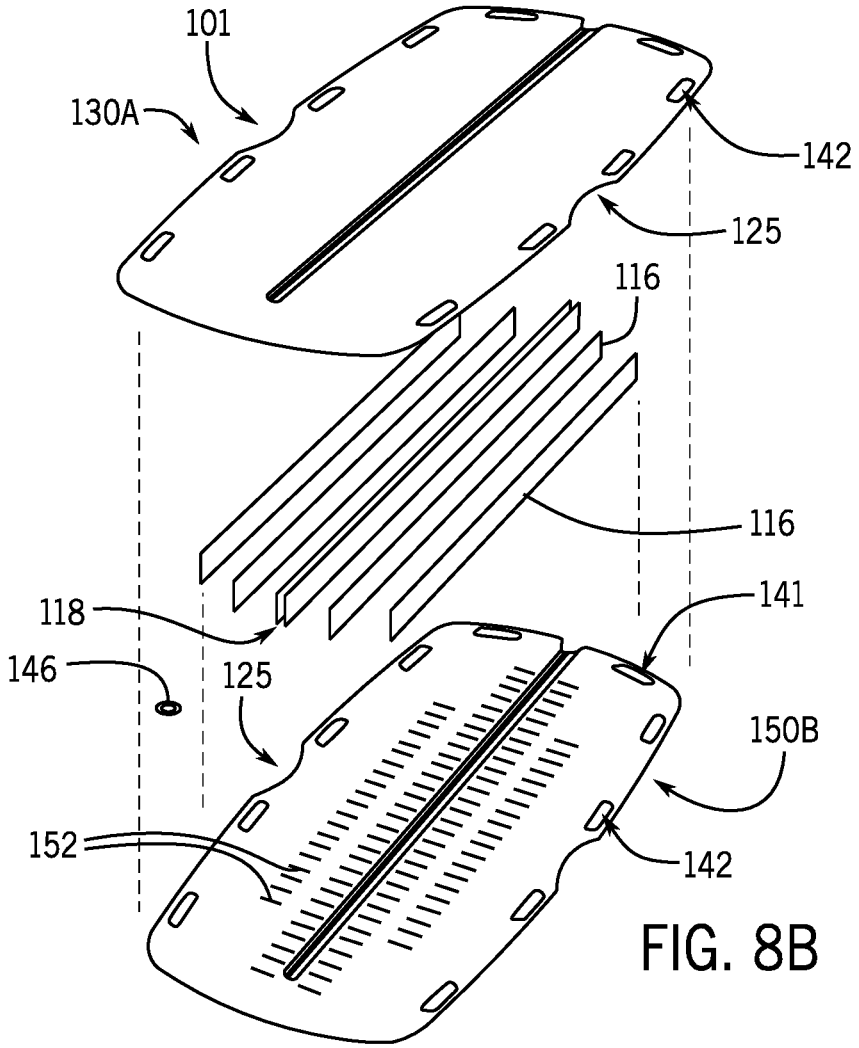
FIG. 8B is an exploded view of an air-bearing patient support for the system of FIG. 8A.

FIG. 8A is a perspective view of the patient transfer system 100, with longitudinal baffles 118 extending along each of the longitudinal sections 104, 106. FIG. 8B is an exploded view of an air-bearing patient support 101 for the system of FIG. 8A.

As shown in FIGS. 8A and 8B, the top and bottom surfaces 130, 150 of the air-bearing patient support 101 can be formed of separate panels 130A, 150B, which are attached together about the perimeter 125 by welding, heat bonding, RF bonding, chemical bonding, or a similar mechanical attachment and pressure sealing process. Internal baffles 116 are attached between the top panel 130A defining top surface 130 of patient support 101, and the bottom panel 150B defining the bottom surface 150 with perforations 152, in a longitudinal orientation extending along the first and second longitudinal sections generally parallel to the selective engagement or releasable seam 118, extending along split 102 between sections 104, 106.

The releasable seam 118 can be provided in various suitable forms, with or without additional releasable attachment or selective bonding materials, including a perforated longitudinal seam 118 or similar seam structure 118 with suitable release characteristics under a transverse or perpendicular force. Suitable examples of the releasable seam 118 also encompass separation seam features 118 defined on the interior surfaces of the top and bottom layers or panels 130A, 150B of the inflatable (air-bearing) patient support 101, and seam features 118 configured in such a way that the welding process weakens the lateral or transverse structure of the panel material 130A or 105B (or both), adjacent or parallel (along) the seam 118 at the welded perimeter 125 (on the same side of the device 101), so as to act as a separation point or release feature for the seam 118 in response to a transverse force.

These design allow for separation of longitudinal sections 104, 106 along seam 118 under similar selective release conditions as a perforated seam 118, in an embodiment utilizing the welding or bonding process to define the release point for the seam 118, as shown in FIGS. 8A and 8B, without requiring actual perforations extending along the seam 118 or slit 102. Alternatively a combination processes can be used to define the seam 118, e.g., with the release point defined along the seam 118 at welded perimeter 125, adjacent proximal portion 108 (at the patient's head), with or without perforations along the longitudinal extent of seam 118 in middle (torso) portion 110 and distal (lower limb) portions 112, 113.

Figure 9A:
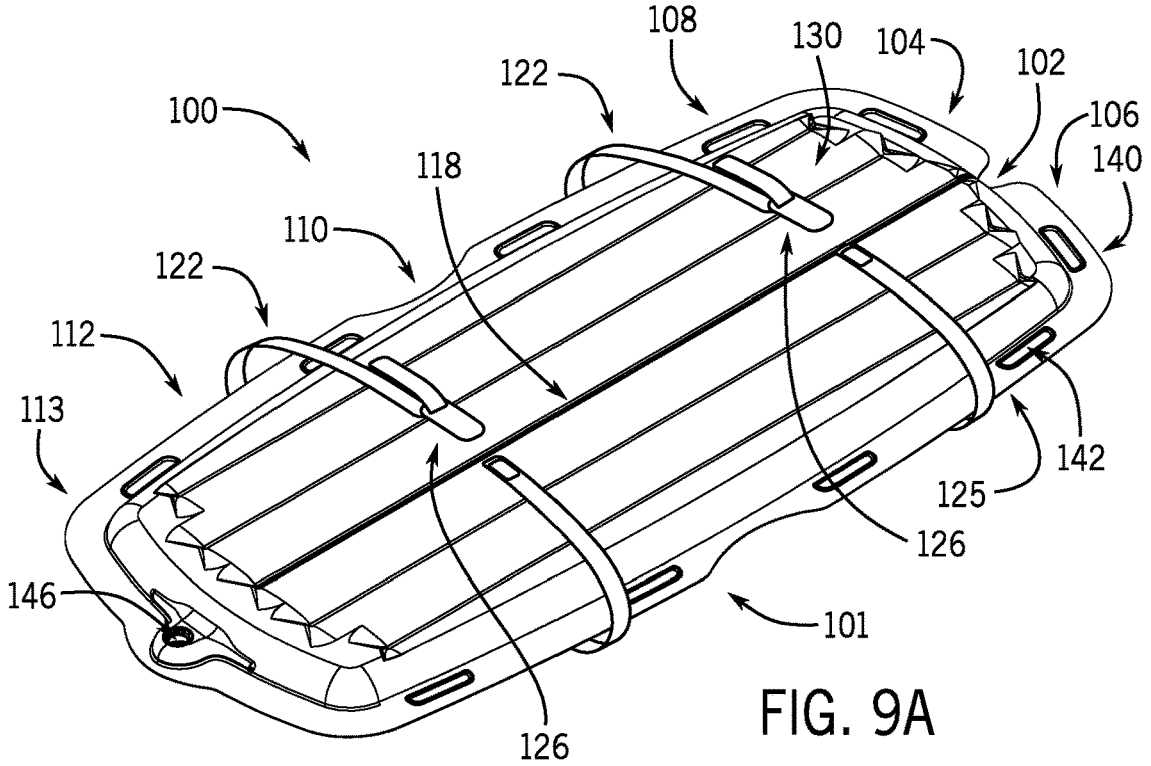
FIG. 9A is a perspective view of the patient transfer system with straps.

FIG. 9A is a top perspective view of an alternate patient transfer system 100. As compared to the embodiment of FIG. 1A, the patient transfer system 100 of FIGS. 9A and 9B can also be formed of a welded polymer sheet design. In this process, the top and bottom layers of the patient support 101 are "stamped" together or disposed one on top of the other, and welded together at the perimeter 125 to define the inflatable air-bearing patient support 101. Suitable welding processes include, but are not limited to, heat welds, chemical welding, and radio frequency (RF) welding methods. Additional welds can be used to define or attach other features such as handles 140, 142, along with additional features such as internal baffles.

Figure 9B:
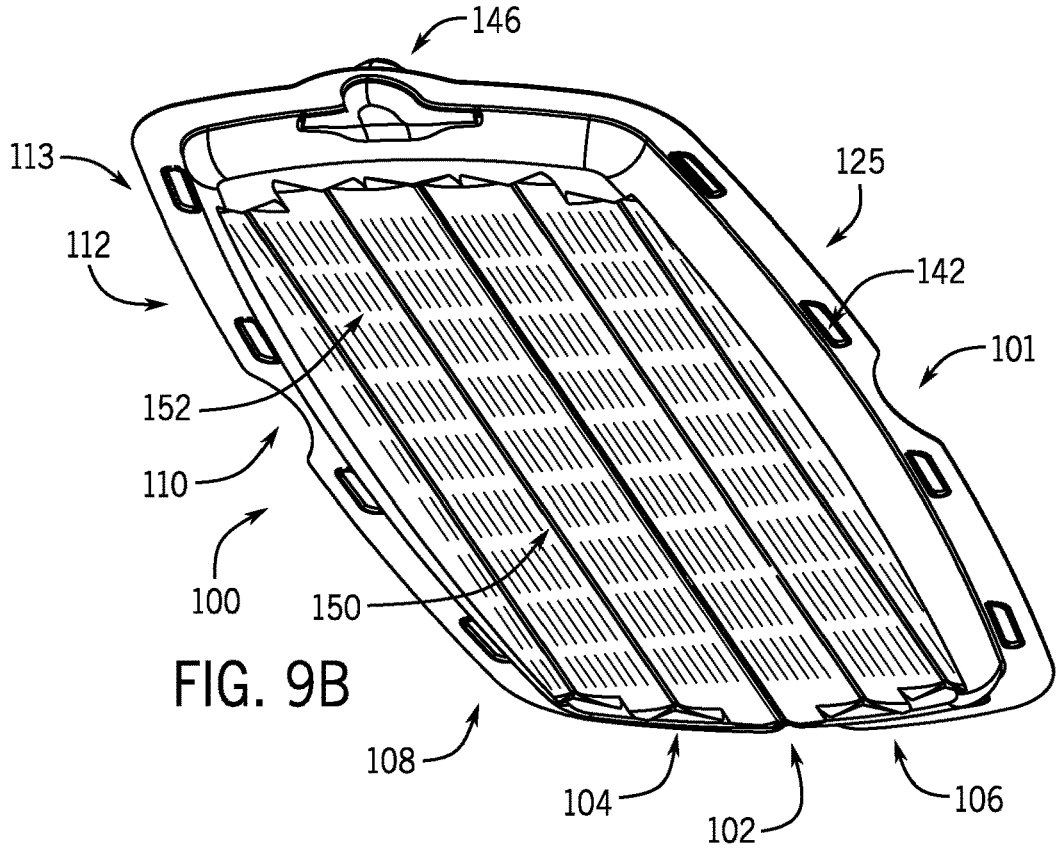
FIG. 9B is an alternate perspective view of the patient transfer system of FIG. 9A.

FIG. 9B is a bottom perspective view of the patient transfer system 100. The inflatable patient transfer system 100 is configured to support a patient's body on the inflated patient support 101, distributing the patient's weight more evenly over the bottom surface 150 and reducing friction to facilitate the patient transfer. As in FIG. 2 above, the bottom surface 150 of the support 101 may also include a plurality of small apertures, perforations, slots or rows of holes 152, which are configured to allow air inside of the inflated bed or patient support 101 to escape in a controlled manner, so as to provide a cushion of air flowing beneath the bottom surface 150. Depending on design, sufficient airflow can be generated through the holes or apertures 152 to at least partially support the bottom surface 150, reducing frictional contact with the transfer surfaces in order to move the system 100 while a patient is lying on the patient support 101.

Referring to FIGS. 9A and 9B, a perforated longitudinal seam 118 can be used to secure the longitudinal sections 104, 106 together across the axial separation 102 during the transfer process. The seam 118 can function as a release point or release mechanism for separating the sections 104, 106 after the transfer.

Figure 10A:
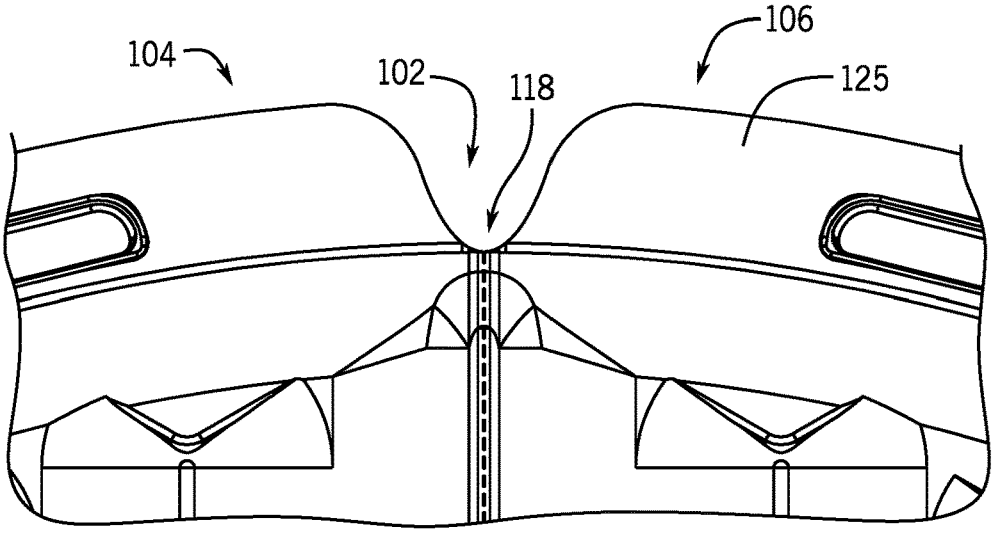
FIG. 10A is a plan view of the patient transfer system of FIG. 9A, showing a separable seam.
Figure 10B:
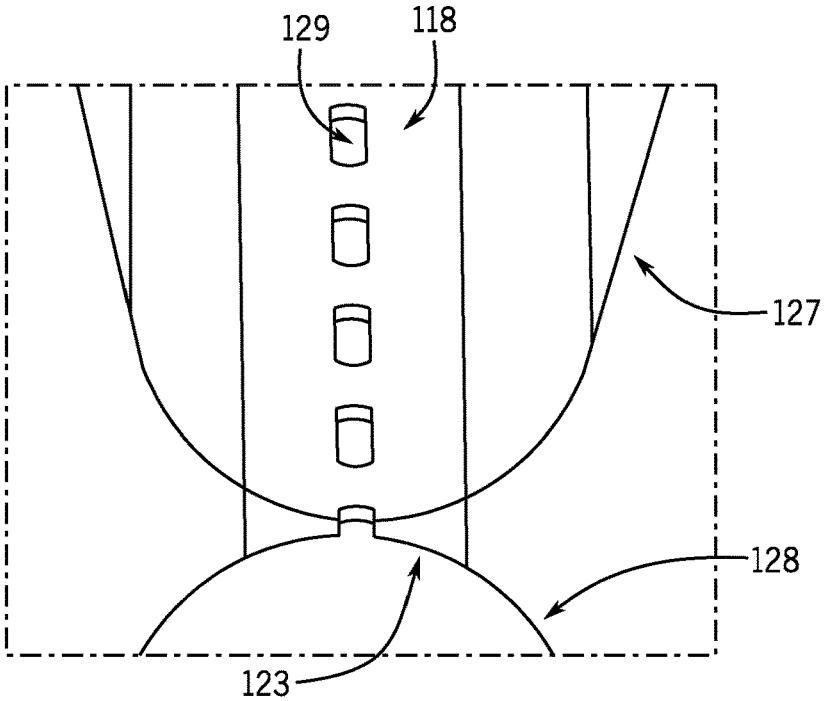
FIG. 10B is an enlarged view of the seam of FIG. 10A.

FIG. 10A is a plan view of the patient transfer system of FIG. 9A, showing a separable seam. FIG. 10B is an enlarged view of the seam of FIG. 10A.

As illustrated in FIGS. 10A and 10B, the weld 123 of the top layer 127 and the bottom layer 128 may define the separable seam 118. One or more apertures, recesses, or score lines 129 may formed along the releasable seam 118 to facilitate separation of the longitudinal sections 104, 106 along the seam 118. This configuration presents the "air bearing" or "air mattress" assembly of patient support device 101 as a substantially single unit, formed of a substantially continuous and unitary or homogeneous (uniform) material, as opposed to using a partitioned unit with two separate sections joined by an intermediary tear surface formed of a different material, e.g., a fabric web or textile material as contemplated in a sewn construction of the patient support 101.

Figure 11A:
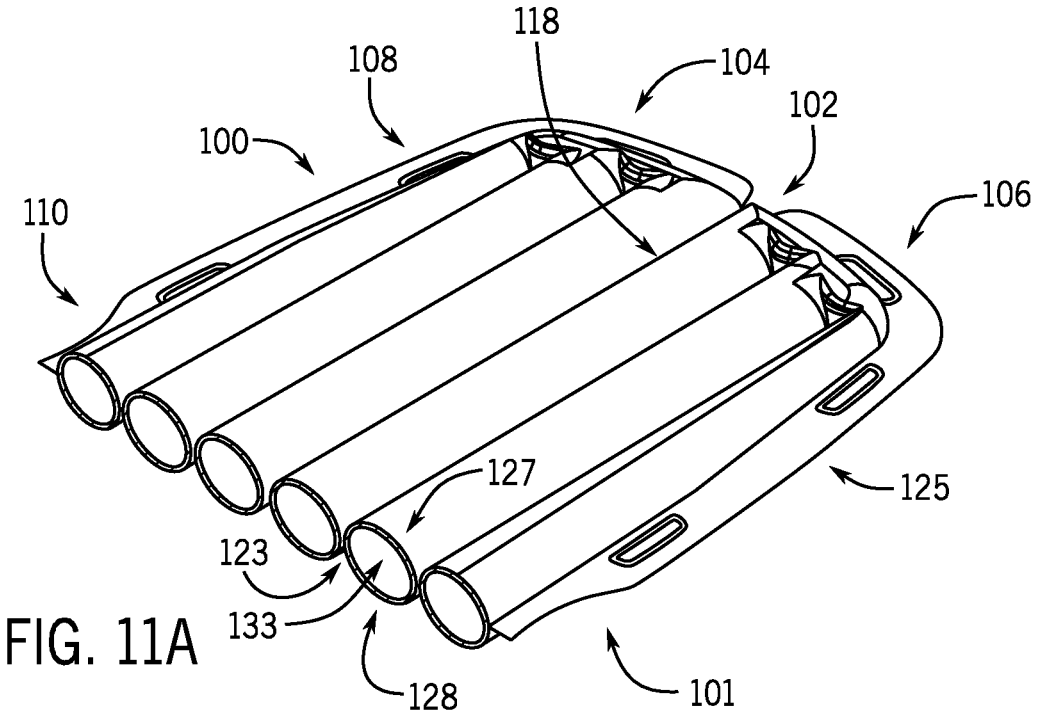
FIG. 11A is a cross-sectional view of the patient transfer system of FIG. 9A, showing internal structure.
Figure 11B:
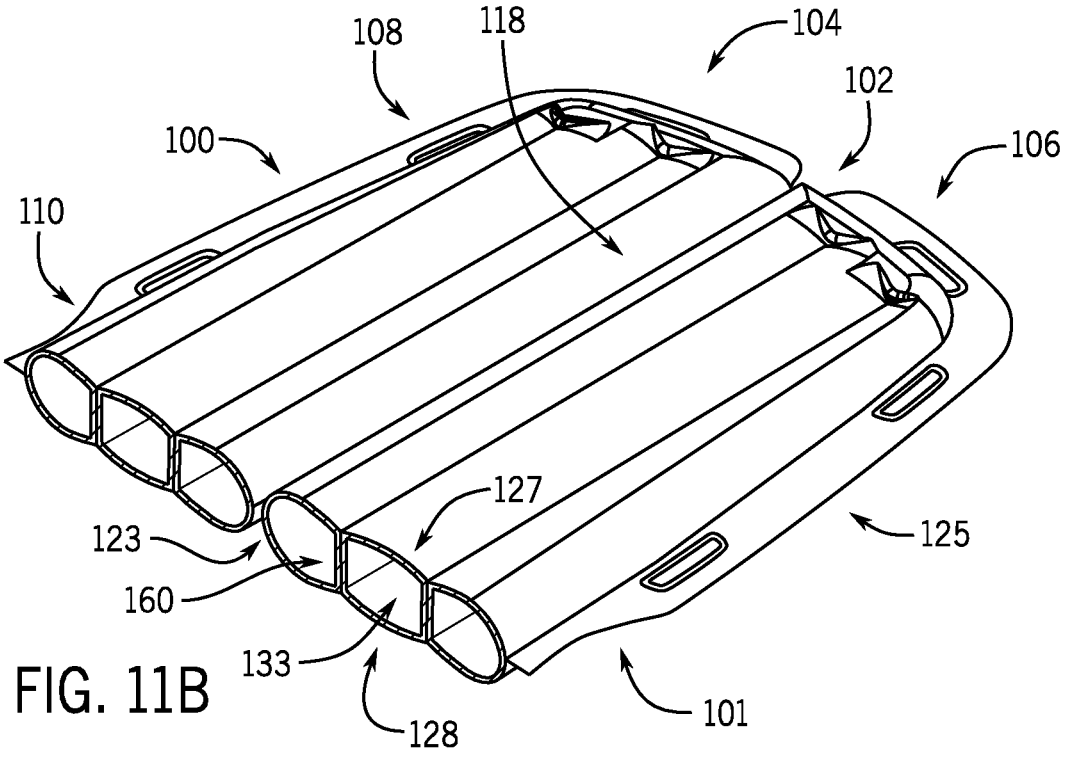
FIG. 11B is a cross-sectional view of the patient transfer system of FIG. 9A, showing alternate internal structure.
Figure 11C:
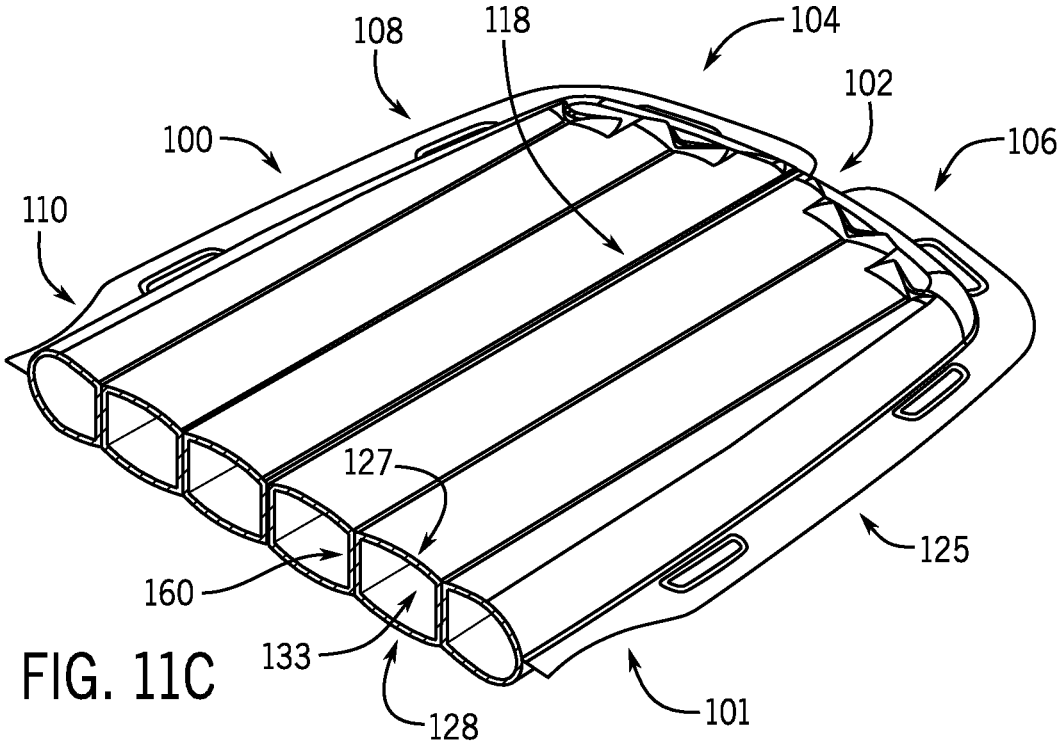
FIG. 11C is a cross-sectional view of the patient transfer system of FIG. 9A, showing alternate internal structure.

FIG. 11A is a cross-sectional view of the patient transfer system of FIG. 9A, showing internal structure. FIG. 11B is a cross-sectional view of the patient transfer system of FIG. 9A, showing alternate internal structure. FIG. 11C is a cross-sectional view of the patient transfer system of FIG. 9A, showing alternate internal structure.

As illustrated in FIGS. 11A, 11B and 11C, the inflatable patient transfer system 100 may include a plurality of internal baffles 160 that direct air flowing through the interior of the patient support 101. Each baffle 160 may be a formed of a substantially oblong or rectangular sheet of polymer or other suitable material, with a top edge attached to the inside of the top layer 127 of the patient support 101, and a bottom edge attached to the inside of the bottom layer 128 of the patient support 101. The baffles 160 may extend along the length of the support 101 and chambers 133 may be formed between the top and bottom layers 127, 128 and adjacent baffles 160.

In various embodiments, the patient transfer system 100 may include no vertical baffles (see FIG. 11A), all vertical baffles 160 (see FIG. 11C), or a combination of sections with vertical baffles 160 and sections with no vertical baffles (see FIG. 11B).

As illustrated in FIG. 11A, the top and bottom layers 127, 128 may be welded together via welds 123, which may extend along the length of the patient support 101. Adjacent welds 123 may be spaced from one another such that chambers 133 are formed between the top and bottom layers 127, 128 and adjacent welds 123. One of the welds 123 (e.g., a center or middle weld) may form the separable seam 118 (see FIG. 10B). As illustrated in FIG. 11B, the welds 123 of FIG. 11A are replaced by baffles 160, except for a center or middle weld 123 used to form the separable seam 118.

As illustrated in FIG. 11C, the patient transfer system 100 may include all vertical baffles 160, and a pair of adjacent baffles 160 may form the split 102. The chambers 133 in any of these various constructs may be sealed off in the air bearing system or air mattress, such that the chambers 133 can be inflated separately (for example, inflating one side to "tip" a patient for positioning or other medical purpose, or inflating the upper torso or legs, but maintaining the capacity to inflate the remaining chambers to effectuate the patient transfer).

Figure 12A:
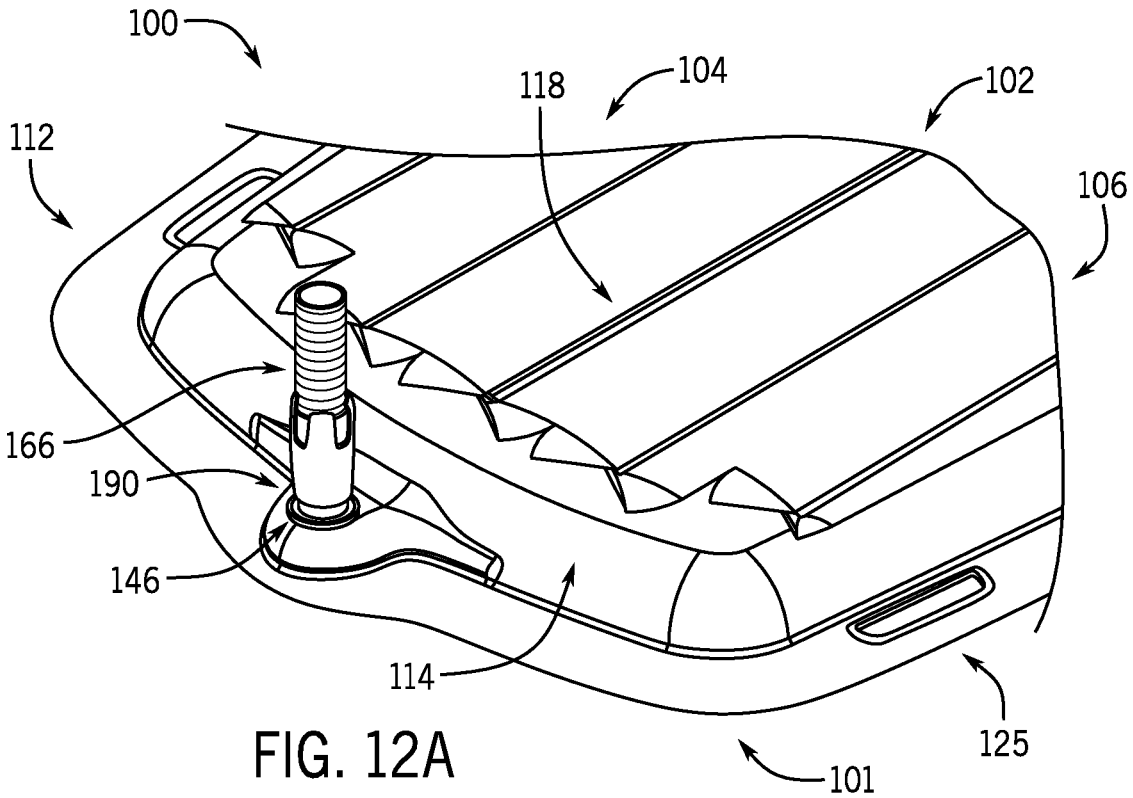
FIG. 12A is a perspective view of the patient transfer system of FIG. 9A, showing a hose adapter inserted into a port.
Figure 12B:
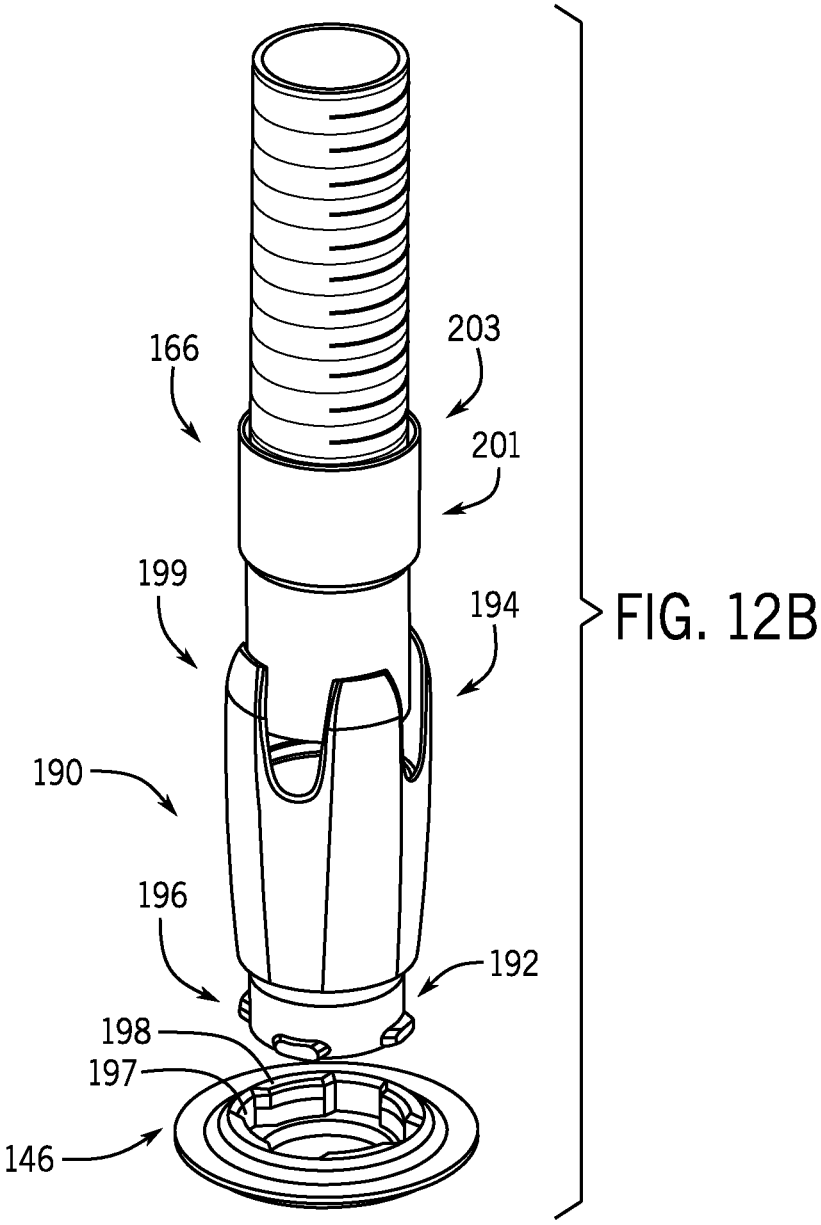
FIG. 12B is a partially exploded view of the hose adapter and port of FIG. 12A.

FIG. 12A is a perspective view of the patient transfer system of FIG. 9A, showing a hose adapter inserted into a port. FIG. 12B is a partially exploded view of the hose adapter and port of FIG. 12A.

The patient transfer system 100 may include one or more fill ports. For example, as illustrated in FIG. 12A, the fill port 146 may be disposed in or adjacent a transverse section 114 of the support 101, or otherwise located in the distal end 112 of the support 101 (e.g., in the lower leg or foot region of the patient's body), generally opposite the start of the split 102 at the proximal end 108 (e.g., in the region of the patient's head). The fill port 146 may be used to inflate the patient transfer system 100 to facilitate transfer of a patient between surfaces.

With continued reference to FIG. 12A, the inflatable patient transfer system 100 may include a hose coupler or adapter 190 to facilitate coupling of various blowers and air supply systems to the fill port 146 via the hose 166, for example. As illustrated in FIG. 12A, the hose adapter 190 may be designed to interface with the fill port 146 on the air-bearing patient support 101 and the hose 166, which may be a third-party supply hose system or may be supplied with system 100. The hose 166 may interface with the outlet of a third-party blower or air supply. The hose adapter 190 may define an internal bore to fluidly couple the patient transfer system 100 with the air supply.

As illustrated in FIG. 12B, the hose adapter 190 may be configured for coupling an existing hose 166 to the port or vent 146. The hose adapter 190 may provide a first interface 192 adapted for coupling to a port 146 on the air-bearing patient support 101, and a second interface 194 configured for coupling to a variety of different hose systems, e.g., using a compressive hose fitting. The first interface 192 may be configured as a bayonet-style connector. For example, as illustrated in FIG. 12B, the first interface 192 may include one or more protrusions 196 that slide through passages 197 formed in the port 146 and are secured behind an internal ledge 198 of the port 146 via rotation of the hose adapter 190 relative to the port 146. In FIG. 12B, the hose adapter 190 includes four protrusions 196 spaced equidistantly around a circumference of the hose adapter 190 for entry into four passages 197 formed in the port 146 and then rotation behind four ledges 198 of the port 146. The hose adapter 190 may include more or less protrusions 196, passages 197, and ledges 198 depending on the application.

The second interface 194 may be configured to be releasably coupled to the hose 166. For example, as illustrated in FIG. 12B, the second interface 194 may include a plurality of axially-extending fingers 199 for grasping the hose 166. The fingers 199 may be configured to grasp a collar 201 of the hose 166. For example, distal ends of the fingers 199 may engage a trailing edge or shoulder 203 of the collar 201 to secure the hose 166 to the hose adapter 190. The fingers 199 may be resilient and may deform during connection and disconnection of the hose 166 to and from the hose adapter 190. As illustrated in FIG. 12B, the fingers 199 may curve inwardly toward a centerline of the hose adapter 190 near the distal ends of the fingers 199 to facilitate engagement of the fingers 199 with the trailing edge of shoulder 203 of the collar 201.

To couple an air supply to the patient transfer system 100, a user may rotationally align the one or more protrusions 196 of the hose adapter 190 with the corresponding passages 197 in the fill port 146. The user may move the hose adapter 190 axially toward the fill port 146 such that the protrusions 196 slide through the passages 197, and then the user may rotate hose adapter 190 relative to the fill port 146 to move the protrusions 196 behind one or more ledges 198 of the fill port 146 to couple the hose adapter 190 to the fill port 146. To couple the hose 166 to the hose adapter 190, the user may insert a distal end of the hose 166 into the second interface 194 of the hose adapter 190 until the resilient fingers 199 snap behind a collar 201 of the hose 166 to couple the hose 166 to the hose adapter 190. The user generally may reverse these steps to remove the hose 166 from the fill port 146.

Methods of Use

Suitable methods for using the patient transport system 100 include transporting a patient or other body 200 across one or more surfaces 210 on the air-bearing support device 101, at least partially deflating one or more inflated sections 104, 106, 114 of the support device 101 positioned beneath the patient, and laterally separating at least a first section 104 and a second section 106 of the device 101 to at least partially remove the device 101 from beneath the patient, e.g., without manipulating the patient's torso region or rolling the patient to their side. Suitable methods may also include, before the at least partially deflating step, inflating one or more deflated sections 104, 106, 114 of the patient transfer device or apparatus 101 positioned beneath the patient 200, and sliding the inflated device 101 and the patient from one surface 210 to another.

More generally, method applications include one or more of disposing a body 200 on an air-bearing support 101 having first and second longitudinal sections 104, 106 attached along a selectively engaged or releasable seam 118, inflating the air-bearing support 101 via an inlet or port 146 in flow communication with the first and second longitudinal sections 104, 106, where the body 200 is supported on the top surface 130 thereof. Transferring the body 200 across one or more surfaces 210 can be accomplished with the body 200 and air-bearing apparatus 101 at least partially supported by airflow, which is directed through a plurality of apertures 152 on the bottom surface 150 of the air-bearing support 101, opposite the top surface 130.

Suitable methods also include detaching the longitudinal sections 104, 106 at a proximal end 108 of the air-bearing support 101, e.g., in the head region of a patient's body 200, and separating the longitudinal sections 104, 106 along the selectively engaged seam 118, from the proximal end 108 of the air-bearing support through a medial portion 110 beneath the patient's torso, and toward a distal end 112 or 113 disposed beneath the patient's lower legs or feet. Removing the longitudinal sections 104, 106 can then be accomplished to opposing sides of the patient's body 200, absent further manipulation such as rolling the torso portion.

The methods can also performed by supporting a head region of the body 200 on or adjacent the proximal end 108 of the air-bearing support 101, and supporting the torso region of the body 200 in a medial region 110 of the air-bearing support 101, e.g., as defined between the proximal 108 and distal ends 112, 113, and where the air-bearing support 101 is inflated for transferring the body 200 across the one or more surfaces 210. Removing the air-bearing support 101 from beneath the torso region of the body can then be performed absent further manipulation of the patient, e.g., where the air-bearing support 101 is deflated subsequent to transferring the body 200 across the one or more surfaces 210.

Additional method steps include strapping the body 200 to the air-bearing support 101, e.g., where the body 200 is secured to the top surface 130 with one or more adjustable straps 122 and adjustable couplings 126 for transferring the body 200 across the one or more surfaces 210. The transfer can be accomplished by caretakers or other operators pulling on one or more handles 142 disposed about a periphery of the air-bearing support 101, e.g., where the body 200 is transferred across the one or more surfaces 210 at least partially supported on the airflow, as directed from the interior of the inflated support 101 through the plurality of apertures 12 on the bottoms surface 150.

More generally, "use" of the system 100 may refer to a single transport of the patient from one surface to another on the patient support 101, or across different surfaces in more than one transport procedure. For example, the same patient support 101 may be used to move a patient from a bed or gurney to an examination table or operating table for a medical procedure, and then to move the patient from the table to a bed or gurney after the procedure, at which time the sections 104, 106 are separated and the device 101 can be removed. Alternatively, the support 101 may be used from multiple transfers before removal, e.g., from a hospital bed to a gurney for transport to an operating table, and then from the operating table back to the gurney, at which time the sections 104, 106 are detached for removal.

EXAMPLES

In a first example, a transfer system may include an air-bearing support having first and second longitudinal sections; a port in flow communication with the first and second longitudinal sections, the port configured for inflation of the air-bearing support for transfer of a body thereon; and a selective coupling extending between the first and second longitudinal sections, the selective coupling configured to attach the first and second longitudinal sections together for transfer of the body on the air-bearing support, and to at least partially detach the first and second longitudinal sections for separation and removal thereof.

The selective coupling of the first example may comprise a selectively releasable seam extending between the longitudinal sections from a proximal end of the air-bearing support toward a distal end of the air-bearing support, the releasable seam configured to detach the longitudinal sections at the proximal end and to separate the longitudinal sections from the proximal end toward the distal end. The releasable seam may be configured to maintain attachment of the longitudinal sections for transfer of the body upon inflation of the air-bearing support, and to detach the longitudinal sections at the proximal end upon deflation of the air-bearing support and application of a manual force. The selective coupling may be configured for detachment of the longitudinal sections at the proximal end, for separation of the longitudinal sections to opposing sides of the body along the releasable seam, and for removal of the air-bearing support from beneath the body absent further substantial manipulation thereof. The selective coupling may extend over a substantially complete longitudinal extent of the air-bearing support, for separation and removal of the longitudinal sections as separate, independent components.

The transfer system of the first example may further comprise a transverse section of the air-bearing support in flow communication with the first and second longitudinal sections, wherein the selective coupling extends between the first and second longitudinal sections to a middle portion of the transverse section for removal of the first and second longitudinal sections as a unit, together with the transverse section. The port may be disposed in the transverse section of the air-bearing support and provided in flow communication with the first and second longitudinal sections thereby.

The port of the first example may comprise an inlet coupling for an external air supply, the external air supply configured for inflation of the air-bearing support. The transfer system may further comprise an air hose attached to the inlet coupling, the air hose adapted for directing airflow from the external air supply to the air-bearing support in a single-use application of the transfer system. The air hose may comprise a collapsible flow section adapted for directing the airflow, the collapsible flow section configured for substantially flat storage in combination with the air-bearing support and for extension from the air-bearing support for in inflation thereof.

The transfer system of the first example may further comprise an integral air supply coupled to the port, the integral air supply adapted for inflation of the air-bearing support in a single-use application of the transfer system.

The selective coupling of the first example may comprise a longitudinal seam structure configured to define a substantially continuous top surface of the air-bearing support across the selective coupling between the first and second longitudinal sections, wherein the body is supported on the substantially continuous top surface upon inflation of the air-bearing support.

The transfer system of the first example may further comprise a plurality of baffles disposed in the one or both of the first and second longitudinal sections, the baffles extending vertically between bottom and top surfaces of the air-bearing support to provide structural integrity upon inflation thereof. The baffles may extend transversely across or with respect to the longitudinal sections and further comprise one or more ports or apertures adapted to admit longitudinal airflow across the baffles upon inflation of the air-bearing support. The baffles may extend longitudinally along or with respect to the longitudinal sections, and further comprise a lateral section in flow communication with the longitudinal sections for inflation thereof.

The selective coupling of the first example may comprise a detachable seam configured for separation and removal of the first and second longitudinal sections upon a single-use transfer application of the air-bearing support, the system being configured for sanitary disposal thereafter. The detachable seam may define a vertical web extending between the first and second longitudinal sections, and further comprise one or more ports or apertures disposed along the detachable seam and configured for transverse airflow between the first and second longitudinal sections upon inflation of the air-bearing support.

The selective coupling of the first example may comprise a perforated seam defined between the first and second longitudinal sections. The first and second longitudinal sections and the perforated seam are formed of a same substantially continuous material.

The transfer system of the first example may further comprise a plurality of flow apertures disposed on a bottom surface of the air-bearing support, the plurality of apertures configured for airflow between the air-bearing support and one or more surfaces across which the transfer of the body is accomplished.

The transfer system of the first example may further comprise one or more straps extending transversely across the first and second longitudinal sections of the air-bearing support, the one or more straps configured for securing the body to the air-bearing support during the transfer.

The transfer system of the first example may comprise one or more handles disposed along a periphery of the air-bearing support, the one or more handles configured for pulling the air-bearing support to accomplish the transfer.

The air-bearing support of the first example may comprise a proximal portion configured to support a head region of the body, a medial portion configured to support a torso region of the body, and a distal portion configured to support a lower region of the body, respectively. The selective coupling may be configured to attach the longitudinal sections together to support the head region and the torso region of the body in the proximal and medial portions, respectively, to detach the longitudinal sections in the proximal portion, and to separate the longitudinal sections from the proximal portion through at least the medial portion for removal of the air-bearing support from beneath the body without rolling the torso portion thereof.

In a second example, an apparatus comprises an air-bearing patient support having a transverse section with first and second longitudinal sections extending therefrom; a port in flow communication with the first and second longitudinal sections via the transverse section, the port configured for inflation of the air-bearing patient support for transfer of a patient on a top surface thereof a plurality of flow apertures disposed on a bottom surface of the air-bearing patient support, the flow apertures configured for airflow from an interior of the air-bearing patient support during the transfer; and a selectively engaged seam extending between the first and second longitudinal sections from a proximal end of the air-bearing support toward a distal end of the air-bearing support, the selectively engaged seam configured to maintain attachment of the longitudinal sections for transfer of the patient upon inflation on the air-bearing support, and for selective detachment of the longitudinal sections at the proximal end for separation and removal upon deflation of the air-bearing support.

The proximal end of the air-bearing patient support of the second example may be adapted to support a head region of the patient and the selectively engaged seam may be configured for separation of the longitudinal sections from the head region of the patient through at least a torso region of the patient.

The selectively engaged seam of the second example may be further configured for removal of the longitudinal sections to opposing sides of the patient, absent further manipulation of the torso region. The selectively engaged seam may extend between the first and second longitudinal sections over a sufficient length of the air-bearing patient support for complete separation and removal of the longitudinal sections as distinct components. The selectively engaged seam may extend to a transverse section of the air-bearing patient support, and the transverse section may join the longitudinal sections for removal together as a unit.

The selectively engaged seam of the second example may be adapted to define a substantially continuous top surface of the air-bearing patient support across the selectively engaged seam extending between the first and second longitudinal sections. The first and second longitudinal sections may be formed of a substantially continuous material, the substantially continuous material defining the perforated seam to extend longitudinally therebetween.

The selectively engaged seam of the second example may be configured for separation and removal of the longitudinal sections upon a single-use transfer application of the air-bearing patient support, the apparatus being configured for sanitary disposal thereafter.

The apparatus of the second example may further comprise a plurality of baffles extending transversely within one or both of the first and second longitudinal sections, the baffles extending vertically between bottom and top surfaces of the air-bearing patient support and configured to admit longitudinal airflow upon inflation thereof.

The apparatus of the second example may further comprise one or more straps extending transversely across the air-bearing patient support for securing the patient thereto.

The apparatus of the second example may further comprise one or more handles disposed along a periphery of the air-bearing patient support to accomplish the transfer by pulling the patient from one surface to another.

The apparatus of the second example may further comprise an absorbent layer portion disposed on the top surface of the air-bearing patient support, the absorbent layer adapted for disposal of fluids with the air-bearing patient support. The apparatus of the second example may further comprise a raised border disposed about the absorbent layer portion, the raised border adapted to direct the fluids to the absorbent layer portion.

The top surface of the air-bearing patient support of the second example may be substantially impervious to fluid, and further comprising a removable absorbent sheet disposed thereon.

The apparatus of the second example may further comprise first and second panels defining the top and bottom surfaces of the air-bearing patient support, respectively, wherein the first and second panels are bonded about a perimeter to define the first and second longitudinal sections with the selectively engaged seam extending therebetween. The perimeter may define a release feature for the selectively engaged seam, the release feature adapted for detachment of the first and second longitudinal sections by separation of the selectively engaged seam at the perimeter, in response to a transverse force. The perimeter may comprise a welded attachment between the first and second panels, the welded attachment defining the release feature at an intersection of the selectively engaged seam and the perimeter.

In a third example, a method comprises disposing a body on an air-bearing support having first and second longitudinal sections attached along a selectively engaged seam; inflating the air-bearing support via a port in flow communication with the first and second longitudinal sections; wherein the body is supported on a top surface thereof; transferring the body across one or more surfaces at least partially supported by airflow directed through a plurality of apertures on a bottom surface of the air-bearing support, opposite the top surface; detaching the longitudinal sections at a proximal end of the air-bearing support; separating the longitudinal sections along the selectively engaged seam, from the proximal end of the air-bearing support toward a distal end of the air-bearing support; and removing the longitudinal sections to opposing sides of the body, absent further manipulation thereof.

The method of the third example may further comprise supporting a head region of the body on or adjacent the proximal end of the air-bearing support and supporting a torso region of the body in a medial region of the air-bearing support defined between the proximal and distal ends, wherein the air-bearing support is inflated for transferring the body across the one or more surfaces. The method may further comprise removing the air-bearing support from beneath the torso region of the body absent further manipulation thereof, wherein the air-bearing support is deflated subsequent to transferring the body across the one or more surfaces.

The method of the third example may further comprise strapping the body to the air-bearing support, wherein the body is secured to the top surface for transferring across the one or more surfaces. The method may further comprise pulling on one or more handles disposed about a periphery of the air-bearing support, wherein the body is transferred across the one or more surfaces at least partially supported on the airflow directed from the plurality of apertures.

The method of the third example may further comprise separating the longitudinal sections comprises separating the longitudinal sections from the proximal end through the distal end of the air-bearing support, and wherein removing the longitudinal sections comprises removing the first and second longitudinal sections as distinct, completely separated components.

Separating the longitudinal sections of the method of the third example may comprise separating the longitudinal sections from the proximal end to a lateral section of the air-bearing support, and wherein removing the longitudinal sections comprises removing the first and second longitudinal sections joined together by the transverse section.

The method of the third example may further comprise deflating the air-bearing support upon transferring the body across one or more surfaces. Inflating the air-bearing support, transferring the body and deflating the air-bearing support may be performed iteratively prior to separating and removing the longitudinal sections.

While this invention has been described with reference to exemplary embodiments, it will be understood by those skilled in the art that various changes can be made and different equivalents may be substituted for particular elements thereof, without departing from the spirit and scope of the invention. The invention is thus not limited to the particular examples that are disclosed, but can also be adapted to different problems and situations, and applied with different materials and techniques, without departing from the essential scope of embodiments encompassed by the appended claims.

The invention claimed is:

1. A method comprising:

disposing a patient on an air-bearing support having first and second longitudinal sections attached along a selectively engaged seam, and further comprising:

a port in flow communication with the first and second longitudinal sections, the port configured for inflation of the air-bearing support for transfer of the patient on a top surface thereof;

a plurality of flow apertures disposed on a bottom surface of the air-bearing support, the flow apertures configured for airflow from an interior of the air-bearing support during the transfer; and the selectively engaged seam extending between the first and second longitudinal sections from a proximal end of the air-bearing support toward a distal end of the air-bearing support;

inflating the air-bearing support via the port in flow communication with the first and second longitudinal sections, wherein the selectively engaged seam is configured to maintain attachment of the longitudinal sections for transfer of the patient on the top surface of the air-bearing support;

transferring the patient across one or more surfaces at least partially supported by airflow directed through the plurality of flow apertures on the bottom surface of the air-bearing support, opposite the top surface;

detaching the longitudinal sections at the proximal end of the air-bearing support;

separating the longitudinal sections along the selectively engaged seam from the proximal end toward the distal end of the air-bearing support; and removing the longitudinal sections to opposing sides of the patient, absent further manipulation thereof.

2. The method of claim 1, further comprising supporting a head region of the patient on or adjacent the proximal end of the air-bearing support and supporting a torso region of the patient in a medial region of the air-bearing support defined between the proximal and distal ends, wherein the air-bearing support is inflated for transferring the patient across the one or more surfaces.

3. The method of claim 2, further comprising removing the air-bearing support from beneath the torso region of the patient absent further manipulation thereof, wherein the air-bearing support is deflated subsequent to transferring the patient across the one or more surfaces.

4. The method of claim 1, wherein separating the longitudinal sections comprises separating the longitudinal sections over a length of the air-bearing support, and wherein removing the longitudinal sections comprises removing the first and second longitudinal sections as distinct, completely separated components.

5. The method of claim 1, wherein separating the longitudinal sections comprises separating the longitudinal sections from the proximal end to a transverse section of the air-bearing support, and wherein removing the longitudinal sections comprises removing the first and second longitudinal sections joined together by the transverse section.

6. The method of claim 1, further comprising deflating the air-bearing support upon transferring the patient across the one or more surfaces.

7. The method of claim 6, wherein inflating the air-bearing support, transferring the patient and deflating the air-bearing support are performed iteratively prior to separating and removing the longitudinal sections.

8. The method of claim 1, wherein the selectively engaged seam is adapted to define a substantially continuous top surface of the air-bearing support across the selectively engaged seam extending between the first and second longitudinal sections and the selectively engaged seam defines a vertical web attachment structure between the first and second longitudinal sections.

9. The method of claim 1, further comprising releasing a release feature of the selectively engaged seam in response to a transverse force, wherein the release feature is adapted for separating the selectively engaged seam at a perimeter of the air-bearing support.

10. The method of claim 1, wherein separating and removing the longitudinal sections comprises selectively detaching the first and second longitudinal sections in response to a transverse force, and removing the longitudinal sections absent further manipulation of the patient in a torso region thereof.

11. The method of claim 1, wherein transferring the patient comprises transferring a patient with a weight of 100 pounds (or 450 N) or heavier, and wherein removing the longitudinal sections comprises removing the longitudinal sections from beneath the patient without rolling the patient to one side or another.

12. The method of claim 11, wherein transferring the patient comprises transferring a bariatric or obese patient.

13. A method comprising:

disposing a patient on an air-bearing support having first and second longitudinal sections attached along a selectively engaged seam, and further comprising:

a port in flow communication with the first and second longitudinal sections, the port configured for inflation of the air-bearing support for transfer of the patient on a top surface thereof;

a plurality of flow apertures disposed on a bottom surface of the air-bearing support, the flow apertures configured for airflow from an interior of the air-bearing support during the transfer; and the selectively engaged seam extending between the first and second longitudinal sections from a proximal end of the air-bearing support toward a distal end of the air-bearing support;

inflating the air-bearing support via the port in flow communication with the first and second longitudinal sections, wherein the selectively engaged seam is configured to maintain attachment of the longitudinal sections for transfer of the patient on the top surface of the air-bearing support;

transferring the patient across one or more surfaces at least partially supported by airflow directed through the plurality of flow apertures on the bottom surface of the air-bearing support, opposite the top surface;

deflating the air-bearing support;

detaching the longitudinal sections at the proximal end of the air-bearing support;

separating the longitudinal sections along the selectively engaged seam from the proximal end toward the distal end of the air-bearing support; and removing the longitudinal sections to opposing sides of the patient without rolling the patient to one side or another.

14. The method of claim 13, further comprising supporting a head region of the patient on or adjacent the proximal end of the air-bearing support.

15. The method of claim 14, further comprising removing the air-bearing support from beneath a torso region of the patient absent further manipulation thereof.

16. The method of claim 13, wherein separating the longitudinal sections comprises separating the longitudinal sections into distinct, completely separated components.

17. The method of claim 13, wherein separating the longitudinal sections comprises separating the longitudinal sections from the proximal end to a transverse section of the air-bearing support, and wherein removing the longitudinal sections comprises removing the first and second longitudinal sections joined together by the transverse section.

18. The method of claim 13, wherein inflating the air-bearing support, transferring the patient and deflating the air-bearing support are performed iteratively prior to separating and removing the longitudinal sections.

19. The method of claim 13, wherein separating and removing the longitudinal sections comprises selectively detaching the first and second longitudinal sections at a release feature defined in a perimeter of the air-bearing support in response to a transverse force.

20. The method of claim 13, wherein the patient has a weight of 100 pounds (or 450 N) or more.

* * * * *